US012584265B2

(12) United States Patent
Kwon et al.

(10) Patent No.: US 12,584,265 B2
(45) Date of Patent: Mar. 24, 2026

(54) LAUNDRY TREATING APPARATUS AND METHOD FOR CONTROLLING THE SAME

(71) Applicant: LG Electronics Inc., Seoul (KR)

(72) Inventors: Sanghyuk Kwon, Seoul (KR); Sanghun Bae, Seoul (KR); Bongjae Kim, Seoul (KR); Jangseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 857 days.

(21) Appl. No.: 17/528,812

(22) Filed: Nov. 17, 2021

(65) Prior Publication Data

US 2022/0154387 A1 May 19, 2022

(30) Foreign Application Priority Data

Nov. 17, 2020 (KR) ..... 10-2020-0153912

(51) Int. Cl.
*D06F 43/08* (2006.01)
*D06F 33/32* (2020.01)
(Continued)

(52) U.S. Cl.
CPC ..... *D06F 43/083* (2013.01); *D06F 43/085* (2013.01); *D06F 33/32* (2020.02); *D06F 34/18* (2020.02); *D06F 35/00* (2013.01); *D06F 37/26* (2013.01); *D06F 37/304* (2013.01); *D06F 37/40* (2013.01); *D06F 39/04* (2013.01);
(Continued)

(58) Field of Classification Search
CPC ..... D06F 43/083; D06F 43/085; D06F 34/18; D06F 2103/24; D06F 2105/48; D06F 2105/58; D06F 43/081; D06F 43/02; D06F 35/00; D06F 33/32; D06F 37/26; D06F 37/304; D06F 37/40; D06F 39/04;
(Continued)

(56) References Cited

U.S. PATENT DOCUMENTS 5,669,251 A * 9/1997 Townsend ..... D06F 43/00 68/184
5,943,721 A * 8/1999 Lerette ..... D06F 43/02 68/18 C
(Continued)

FOREIGN PATENT DOCUMENTS

EP 2576886 3/2017
GB 2080836 A * 2/1982 ..... D06F 37/225
(Continued)

OTHER PUBLICATIONS

GB2080836 translation (Year: 1982).*
(Continued)

*Primary Examiner* — Michael E Barr
*Assistant Examiner* — Lauren G Orta
(74) *Attorney, Agent, or Firm* — Fish & Richardson P.C.

(57) ABSTRACT

A laundry treating apparatus includes a pressure vessel configured to receive fluid and to maintain a pressure therein to be higher than an atmospheric pressure, a separator that divides the pressure vessel into a first chamber and a second chamber, a drum rotatably disposed in the first chamber and configured to accommodate laundry therein, a driver configured to rotate the drum, and a pump configured to cause the fluid to flow between the first chamber and the second chamber.

20 Claims, 23 Drawing Sheets

(51) Int. Cl.

| | |
|---|---|
| ***D06F 34/18*** | (2020.01) |
| ***D06F 35/00*** | (2006.01) |
| ***D06F 37/26*** | (2006.01) |
| ***D06F 37/30*** | (2020.01) |
| ***D06F 37/40*** | (2006.01) |
| ***D06F 39/04*** | (2006.01) |
| ***D06F 39/10*** | (2006.01) |
| ***D06F 39/12*** | (2006.01) |
| ***D06F 43/02*** | (2006.01) |
| ***D06F 103/24*** | (2020.01) |
| ***D06F 105/48*** | (2020.01) |
| *D06F 105/58* | (2020.01) |

(52) U.S. Cl.
CPC ..... *D06F 39/10* (2013.01); *D06F 39/12* (2013.01); *D06F 43/02* (2013.01); *D06F 43/081* (2013.01); *D06F 2103/24* (2020.02); *D06F 2105/48* (2020.02); *D06F 2105/58* (2020.02)

(58) Field of Classification Search
CPC ..... D06F 39/10; D06F 39/12; D06F 43/00; D06F 43/005; D06F 43/04
See application file for complete search history.

(56) References Cited

U.S. PATENT DOCUMENTS 5,970,554 A * 10/1999 Shore ..... G01F 23/22 68/18 F
6,237,373 B1 5/2001 Harris et al.
2004/0020510 A1 2/2004 Roseen
2005/0034247 A1* 2/2005 Uhlin ..... D06F 43/00 8/142
2005/0043196 A1* 2/2005 Wright ..... D06L 1/08 510/276
2005/0091756 A1* 5/2005 Wright ..... D06F 43/085 8/137
2007/0277562 A1* 12/2007 Uhlin ..... D06F 43/02 68/140
2008/0271263 A1* 11/2008 Bae ..... D06F 58/203 8/159
2013/0167558 A1* 7/2013 Jassani ..... D06F 43/083 62/467
2022/0154388 A1* 5/2022 Bae ..... D06F 43/085

FOREIGN PATENT DOCUMENTS

| | | |
|---|---|---|
| KR | 20010096995 | 11/2001 |
| KR | 20080107500 | 12/2008 |
| KR | 20140123941 | 10/2014 |
| KR | 20180039998 | 4/2018 |
| WO | WO2004042134 | 5/2004 |

OTHER PUBLICATIONS

Extended European Search Report in European Appln. No. 21208471.9, dated May 23, 2022, 9 pages.
International Search Report & Written Opinion in International Appln. No. PCT/KR2021/016829, dated Feb. 24, 2022, 9 pages.

* cited by examiner

LAUNDRY TREATING APPARATUS AND METHOD FOR CONTROLLING THE SAME

CROSS-REFERENCE TO RELATED APPLICATIONS

This application claims the benefit of Korean Patent Application No. 10-2020-0153912, filed on Nov. 17, 2020, which is hereby incorporated by reference as if fully set forth herein.

TECHNICAL FIELD

The present disclosure relates to a laundry treating apparatus and a method for controlling the same. More particularly, the present disclosure relates to a laundry treating apparatus that performs laundry treatment such as washing or the like using carbon dioxide, and a method for controlling the same.

BACKGROUND

A laundry treating apparatus may perform washing and drying laundry at home or in other places, and can remove wrinkles on the laundry. For example, the laundry treating apparatus can include a washing machine that washes the laundry, a dryer that dries the laundry, a washing machine/dryer that has both a washing function and a drying function, a laundry manager that refreshes the laundry, a steamer that removes the wrinkles from the laundry, and the like.

The laundry treating apparatus may treat the laundry using water. In some cases, after a washing cycle has been completed, water can remain on the laundry even after a dehydration process. In order to dry the wet laundry, the laundry can be dried naturally or by hot air supplied through a separate drying cycle with additional time for the drying cycle.

The laundry treating apparatus may use water and detergent to foreign substances adhered to or adsorbed on the laundry. In some cases, instead of water, an organic solvent such as perchlorethylene (PCE) can be used to remove lipophilic foreign substances. Because the organic solvent is volatile, the drying cycle can be shorter than the drying cycle using the water. In some cases, in removing the lipophilic foreign substances, there is a limitation in removing water-soluble foreign substances. In some cases, after the drying cycle using the hot air is performed, a smell of a remaining volatile organic compound may give an unpleasant feeling and stay for a long time. In some examples, perchlorethylene is harmful to an environment, and it has been designated as a carcinogen by the US Environmental Protection Agency.

Carbon dioxide ($CO_2$) may be used as a new cleaning solvent to prevent or reduce such carcinogen and environmental pollution. Carbon dioxide is a colorless and odorless gas at an ambient pressure and at a room temperature, and carbon dioxide may evaporate when a washing process at a high pressure is completed and the pressure is lowered to the atmospheric pressure, which may obviate the need for a separate drying cycle. In some examples, as carbon dioxide is one of components of general atmosphere, carbon dioxide may not pollute the environment. In some examples, when a surfactant for carbon dioxide is used, it may be possible to remove hydrophilic foreign substances.

In some examples, a washing machine, which washes the laundry using carbon dioxide as the cleaning solvent, may use a washing space in which the laundry is accommodated and a space in which a motor is installed in one chamber without distinction. In some cases, liquid carbon dioxide may be filled up to the space in which the motor is installed. In this case, because liquid carbon dioxide fills the space that is not used for the washing, an amount of carbon dioxide for the washing may increase. In some examples, because the chamber for accommodating carbon dioxide may become large due to the large amount of carbon dioxide, a size of the entire washing machine may also increase, thereby taking up a large space.

In some examples, a dry cleaning apparatus may use carbon dioxide as the cleaning solvent, and may flow and treat carbon dioxide at major stages in a washing cycle. For instance, the dry cleaning apparatus may be filled with gaseous carbon dioxide and liquid carbon dioxide throughout an interior of a pressure vessel (or a washing chamber) during washing and rinsing. Carbon dioxide may be filled in the pressure vessel from a storage tank and a replenishment tank to do the washing using carbon dioxide, and carbon dioxide may flow from the pressure vessel to a distillation tank after the washing is completed. In some cases, the dry cleaning apparatus may perform a method for purifying carbon dioxide in the distillation tank through a compressor, then transferring carbon dioxide to the storage tank, and then reusing carbon dioxide.

In some cases, where the dry cleaning apparatus includes three or more pressure vessels such as the washing chamber, the storage tank, and the distillation tank, the apparatus may be large and heavy. When a strength of a floor supporting the dry cleaning apparatus is not sufficient, a reinforcement work may help to withstand a load of the dry cleaning apparatus. In some cases, the dry cleaning apparatus may be installed by special equipment such as a crane.

In some cases, where complex pipes connect the pressure vessels to each other, in the event of a problem with a pressure vessel, many interfering pipes may be removed to allow access to the pressure vessel. In some examples, because the pressure vessel is moved or removed to provide access, maintenance may be difficult. In some examples, the complex pipes together with the several pressure vessels may include the size of the laundry treating apparatus.

In some examples, when the washing chamber and the storage tank are combined into one pressure vessel, a pressure difference between carbon dioxide respectively accommodated in the washing chamber and the storage tank may stress a component that separates the wash chamber and the storage tank from each other. In some examples, an axial load may result from the pressure difference and be applied on a rotation shaft that rotates the drum. In some cases, a structure of a sealing portion that prevents a flow of liquid carbon dioxide may be complicated. In some cases, where liquid carbon dioxide may come into contact with a driver such as a motor, durability of the driver may be an issue.

SUMMARY

The present disclosure describes a laundry treating apparatus having a washing space in which carbon dioxide is used and a storage space for storing purified carbon dioxide in a single pressure vessel.

The present disclosure further describes a laundry treating apparatus that simplifies connection of pipes through which carbon dioxide flows.

The present disclosure further describes a laundry treating apparatus configured to purify and reuse carbon dioxide used in washing and rinsing operations.

The present disclosure further describes a laundry treating apparatus having a washing chamber, which is defined by a single vessel, as two spaces divided by a partition wall, where deformation of the partition wall can be reduced or prevented by achieving a pressure equilibrium between the two spaces.

The present disclosure further describes a structure that can block liquid carbon dioxide from flowing between the two spaces through a gap in the partition wall.

The present disclosure further describes a structure that can block contact between liquid carbon dioxide and a driver.

The present disclosure further describes a compact laundry treating apparatus that uses the single pressure vessel, has the simplified pipe connection, and exhausts carbon dioxide to the outside after use.

In some implementations, a laundry treating apparatus can block flow of liquid carbon dioxide inside a washing tub and reuse carbon dioxide through a partition wall structure that separates spaces. For instance, the laundry treating apparatus can use carbon dioxide as a cleaning solvent and include the partition wall that separates an interior of the washing tub, which is a pressure vessel, to block the flow of the liquid carbon dioxide. In some examples, the partition wall can separate spaces on left and right sides into a washing space and a storage space, respectively, to enable washing only with a single vessel.

In some implementations, the carbon dioxide drained after the washing in the washing space on the left side of the washing tub may be purified through a filter and an oil separator, then stored in the storage space on the right side of the washing tub, and then transferred to the washing space again to repeat a rinsing process, in which no additional carbon dioxide is supplied during a washing cycle.

That is, the laundry treating apparatus having the single vessel structure can be miniaturized and simplified compared to an existing laundry treating apparatus using carbon dioxide as the cleaning solvent.

The partition wall, which is a structure that blocks flow of liquid and allows only flow of gas, can separate an inner space of the washing tub into the washing space and the storage space.

In some implementations, the laundry treating apparatus may not use additional carbon dioxide in the repeated rinsing process after the washing by transferring the carbon dioxide purified through the filter and the oil separator after being used in the washing space to the storage space. When the purification is completed, the purified carbon dioxide can be transferred back to the washing space and reused. Therefore, the additional carbon dioxide may not be supplied during one washing cycle.

In some examples, after one washing cycle, by discharging the used carbon dioxide to the outside, it is possible to eliminate an operation of re-storing the carbon dioxide through distillation and recovery processes after the completion of the washing cycle. Therefore, it is possible to reduce complicated pipes and reduce a space for the re-storage.

The structure of the partition wall can block the flow of the liquid carbon dioxide through a lower sealing and define a flow path of gaseous carbon dioxide through an upper vent.

Pressure equilibrium between the washing space and the storage space can reduce a stress on the partition wall and make a sealing structure simple. In some examples, by reducing the number of pressure vessels, it can be possible to reduce a space for installation of the laundry treating apparatus.

In order to block the flow of the liquid carbon dioxide filled in a lower portion of the washing tub, a connection portion between the partition wall and a flange of the washing tub can be sealed with a graphite gasket. A screw hole of a structure supporting a heat exchanger can be composed of a cap nut and an O-ring, which can block the flow of the liquid carbon dioxide.

In some implementations, a ventilation hole can be defined at an upper end of the partition wall at a position where the liquid carbon dioxide does not reach, The gaseous carbon dioxide can flow through the ventilation hole, thereby maintaining pressure equilibrium between the spaces on the left and right sides. In some examples, because there is no difference in pressure between the left and right sides, the graphite gasket simply blocks flow resulted from gravity without blocking the flow of the liquid carbon dioxide resulted from the pressure, so that excessive fastening force may not be provided.

In some examples, a washing cycle of the laundry treating apparatus can include charging—washing and purifying processes—rinsing process after re-charging—purification and rinsing processes—exhaust process.

For example, the liquid carbon dioxide can be first filled in the washing space from a carbon dioxide supply tank for the washing. In some examples, a liquid-free space (the storage space) can be filled with the gaseous carbon dioxide, so that the pressure equilibrium can be maintained.

After the washing, contaminants of the liquid carbon dioxide can be filtered and purified through a filter and an oil separator, and then the purified liquid carbon dioxide can be transferred to the storage space.

Thereafter, the rinsing can be performed after recharging the carbon dioxide in the washing space. After purifying the carbon dioxide, the rinsing process can be performed at least once. In other words, a process of purifying the carbon dioxide again after the rinsing, transferring the purified carbon dioxide to the storage space, and reusing the purified carbon dioxide to perform the rinsing can be repeated. When the repeated rinsing process is completed, the entire washing cycle can be completed by discharging the carbon dioxide to the outside through the ventilation hole.

The present disclosure provides a laundry treating apparatus using the carbon dioxide as the cleaning solvent that eliminates a storage tank and a distillation tank, and uses one pressure vessel (a washing chamber).

In some examples, in order to reduce an amount of carbon dioxide for the entire washing cycle with only one charge of carbon dioxide, provided is a laundry treating apparatus in which an interior of the pressure vessel (the washing chamber) is separated by the partition wall.

That is, a space on one side separated by the partition wall in the washing chamber can be used as the washing space, and the space on the other side can be used as the storage space for the purified carbon dioxide. In the spaces separated by the partition wall, the flow of the liquid carbon dioxide can be blocked, and a communication hole can be defined to allow only the flow of the gaseous carbon dioxide, thereby achieving the pressure equilibrium between the both spaces.

According to one aspect of the subject matter described in this application, A laundry treating apparatus includes a pressure vessel configured to receive fluid and to maintain a pressure therein to be higher than an atmospheric pressure, a separator that divides the pressure vessel into a first chamber and a second chamber, a drum rotatably disposed in the first chamber and configured to accommodate laundry therein, a driver configured to rotate the drum, and a pump configured to cause the fluid to flow between the first chamber and the second chamber.

Implementations according to this aspect can include one or more of the following features. For example, the driver can be located in the second chamber and can include (i) a motor configured to generate a rotation force and (ii) a rotation shaft connected to the drum and configured to transmit the rotation force of the motor. The separator can include a support plate that separates the first chamber and the second chamber from each other, the support plate defining a first through-hole passing therethrough, where the rotation shaft is inserted into the first through-hole and connected to the drum.

In some implementations, the support plate can define at least one second through-hole that is spaced apart from the first through-hole and passes through the support plate, where the first chamber and the second chamber are configured to accommodate the fluid in a gas state, a liquid state, or both, and the at least one second through-hole is configured to communicate the fluid in the gas state between the first chamber and the second chamber to thereby maintain the first chamber and the second chamber in a pressure equilibrium.

In some examples, the pressure vessel can include a first housing that defines the first chamber and accommodates the drum therein, where the first housing defines (i) a chamber inlet configured to receive and withdraw the laundry therethrough and (ii) a first opening facing opposite to the chamber inlet, and a second housing that defines the second chamber and is coupled to the first housing, the second housing defining a second opening facing the first opening. The separator can be coupled to the first housing or the second housing, and the support plate can be coupled to the first housing and located closer to the first opening than to the second opening, where the support plate has a first side facing the first housing and a second side facing the second housing.

In some implementations, the laundry treating apparatus can include a cabinet that accommodates the pressure vessel therein, where a vertical level of a center of the at least one second through-hole with respect to a bottom side of the cabinet is higher than a vertical level of a center of the first through-hole. In some examples, the at least one second through-hole can be located above a vertical level of the fluid in the liquid state accommodated in the first chamber or the second chamber with respect to the bottom side of the cabinet such that the fluid in the liquid state does not flow through the at least one second through-hole.

In some examples, the separator can include a heat exchanger that is located between the drum and the support plate, that is coupled to a side of the support plate facing the drum, and that is configured to supply heat to the first chamber. The heat exchanger can include a first refrigerant pipe configured to supply a refrigerant to the heat exchanger, a second refrigerant pipe configured to discharge the refrigerant that has circulated through the heat exchanger, and a connection refrigerant pipe that connects the first refrigerant pipe and the second refrigerant pipe to each other and is configured to supply heat to the fluid accommodated in the first chamber. The heat exchanger can define a central cavity that faces the first through-hole, and a size of the central cavity can be greater than or equal to a size of the first through-hole. The rotation shaft can be inserted into and passes through the central cavity, and the first refrigerant pipe or the second refrigerant pipe can be inserted into the at least one second through-hole and connected to the heat exchanger.

In some implementations, the separator can include a heat insulator located between the heat exchanger and the support plate and configured to block heat transfer from the heat exchanger to the second chamber, where the heat insulator can include a heat insulator body that is made of a thermal insulation material. The heat insulator body can define a first heat insulator hole facing the first through-hole, where a size of the first heat insulator hole is greater than or equal to the size of the first through-hole, and at least one second heat insulator hole facing the at least one second through-hole. A number and a size of the at least one second heat insulator hole can correspond to a number and a size of the at least one second through-hole, respectively.

In some implementations, the driver can include a bearing housing assembly that couples the motor to the support plate and is configured to rotatably support the rotation shaft, and a motor protection cover that covers the motor and the bearing housing assembly and is configured to block the fluid in a liquid state accommodated in the first chamber or the second chamber from contacting the motor and the bearing housing assembly. The motor protection cover can define at least one cover communication hole passing therethrough, where a vertical level of the at least one cover communication hole is located higher than a vertical level of the fluid in the liquid state accommodated in the second chamber.

In some implementations, the laundry treating apparatus can include a purifier configured to remove contaminants from the fluid discharged from the first chamber. In some implementations, the fluid can include carbon dioxide in a gas state, a liquid state, or both, and the laundry treating apparatus further can include a tank configured to store the carbon dioxide to be supplied to the first chamber. In some implementations, the laundry treating apparatus can include a flow rate regulator configured to supply the carbon dioxide stored in the tank to the first chamber until a pressure in the first chamber reaches an equilibrium with a pressure in the tank.

In some examples, the first chamber can be configured to accommodate both liquid carbon dioxide and gaseous carbon dioxide therein in a state in which the pressure in the first chamber reaches the equilibrium with the pressure in the tank. The drum can be configured to, based on the pressure in the first chamber reaching the equilibrium with the pressure in the tank, rotate at a preset first rotation speed for a preset first time period to thereby remove contaminants from the laundry by bringing the laundry into contact with the liquid carbon dioxide in the first chamber.

In some examples, the laundry treating apparatus can include a purifier configured to purify the liquid carbon dioxide discharged from the first chamber, and the driver can be configured to stop rotating the drum based on an elapse of the preset first time period since starting to rotate at the preset first rotation speed. The pump can be configured to, based on the drum stopping rotation, cause the liquid carbon dioxide mixed with the contaminants removed from the laundry to discharge from the first chamber, pass through the purifier, and be stored in the second chamber. In some examples, the pump can be configured to cause the liquid carbon dioxide stored in the second chamber to be supplied back to the first chamber.

In some implementations, the driver can be configured to rotate the drum at a preset second rotation speed for a preset second time period based on the liquid carbon dioxide stored in the second chamber being transferred back to the first chamber after the elapse of the preset first time period. In some examples, the laundry treating apparatus can include an exhaust portion configured to discharge the carbon dioxide accommodated in the pressure vessel, and the driver can be configured to stop rotating the drum based on an elapse of the preset second time period since starting to rotate at the preset second rotation speed. The exhaust portion is configured to discharge the carbon dioxide accommodated in the pressure vessel to an outside of the exhaust portion based on the elapse of the preset second time period.

In some implementations, the driver can be configured to stop rotating the drum based on an elapse of the preset second time period since starting to rotate at the preset second rotation speed, where the pump can be configured to, based on the drum stopping rotation after the elapse of the preset second time period, cause the liquid carbon dioxide mixed with the contaminants removed from the laundry to discharge from the first chamber, pass through the purifier, and be stored in the second chamber.

In some implementations, the pump can be configured to cause the liquid carbon dioxide stored in the second chamber after the elapse of the preset second time period to be supplied back to the first chamber. In some examples, the driver can be configured to rotate the drum at a third rotation speed for a preset third time period based on the liquid carbon dioxide stored in the second chamber being transferred back to the first chamber after the elapse of the preset second time period.

According to another aspect, the laundry treating apparatus performs a method for treating laundry using carbon dioxide.

In some implementations, the laundry treating apparatus can reduce the weight and the size thereof because multiple pressure vessels are not used except for the supply tank and the washing chamber. This can reduce the size of the installation space, and the reinforcement work of the floor to support the weight of the laundry treating apparatus can be minimized.

The pressure vessel in the present disclosure can help to reduce the size of the laundry treating apparatus by simplifying the connection of the pipes through which carbon dioxide flows.

In some examples, carbon dioxide used in the washing and rinsing operations can be purified and reused.

In some examples, the washing chamber, which is the single vessel, can be used as the two spaces divided by the partition wall, and the deformation of the partition wall may be minimized by achieving the pressure equilibrium between the two spaces.

In some implementations, the laundry treating apparatus has a structure that can block the liquid carbon dioxide from flowing between the two spaces through the gap in the partition wall.

In some implementations, the laundry treating apparatus has a structure that can block the contact between the liquid carbon dioxide and the driver, thereby improving the durability of the driver and enabling the stable operation.

In some implementations, the laundry treating apparatus can have a reduced size by using the single pressure vessel, having the simplified pipe connection, and exhausting carbon dioxide to the outside after use.

DETAILED DESCRIPTION

Hereinafter, one or more implementations of the present disclosure will be described in detail with reference to the accompanying drawings.

In the present disclosure, the description below will be based on a spatial orthogonal coordinate system with an X-axis, a Y-axis, and a Z-axis orthogonal to each other. Each axial direction (an X-axis direction, a Y-axis direction, or a Z-axis direction) means both directions in which each axis extends. Adding a '+' sign in front of each axial direction (a +X-axis direction, a +Y-axis direction, or a +Z-axis direction) means a positive direction, which is one of the two directions in which each axis extends. Adding a '−' sign in front of each axial direction (a −X-axis direction, a −Y-axis direction, or a −Z-axis direction) means a negative direction, which is the other of the two directions in which each axis extends.

Expressions referring to directions such as "front (+Y)/rear (−Y)/left (+X)/right (−X)/up (+Z)/down (−Z)" to be mentioned below are defined based on a XYZ coordinate axis. However, this is to describe the present disclosure such that the present disclosure can be clearly understood. In one example, each direction can be defined differently depending on the standard.

When referring to a phase of carbon dioxide in this specification, liquid-phase carbon dioxide is referred to as liquid carbon dioxide, and gas-phase carbon dioxide is referred to as gaseous carbon dioxide.

Figure 1:
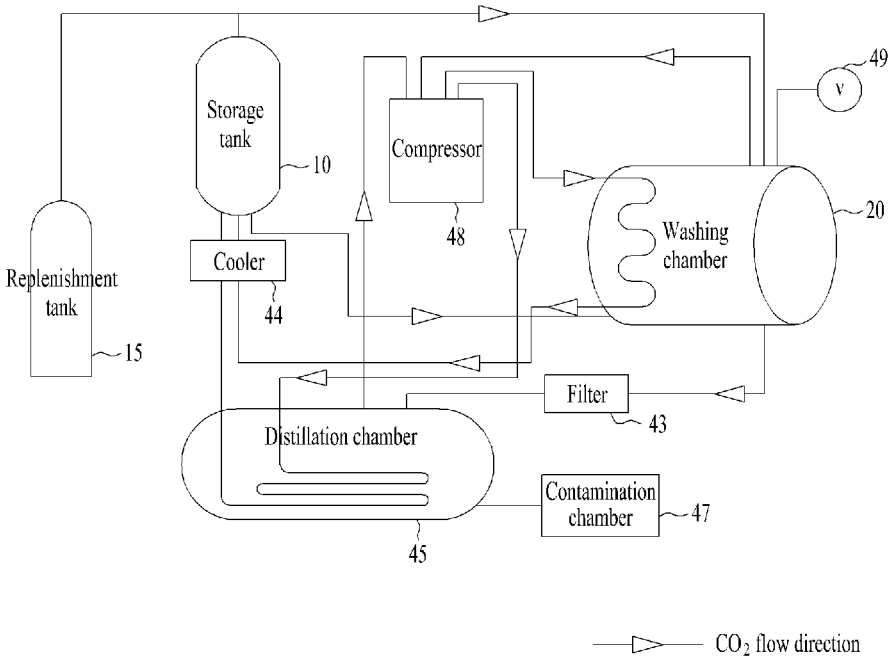
FIG. 1 schematically shows an example of a laundry treating apparatus using carbon dioxide as a cleaning solvent.

FIG. 1 shows an example of treating apparatus using carbon dioxide as a cleaning solvent with components. In the present specification, a washing cycle refers to an entire process or course in which carbon dioxide is supplied as the cleaning solvent, then contaminants are removed from laundry using the carbon dioxide, and then the supplied carbon dioxide is exhausted to the outside again.

In this specification, only an example of using carbon dioxide as the cleaning solvent is given, and a fluid can be used as the cleaning solvent. Because the fluid includes liquid and gas, the fluid is expressed as the liquid or the fluid in the liquid state when referring to the liquid of the fluid, and the fluid is expressed as the gas or the fluid in the gas state when referring to the gas of the fluid.

Referring to FIG. 1, the laundry treating apparatus using carbon dioxide as the cleaning solvent can include a washing chamber 20 that accommodates the laundry therein and performs washing and rinsing using the supplied carbon dioxide, a storage tank 10 that distills the used carbon dioxide, stores the distilled carbon dioxide, and supplies the carbon dioxide to the washing chamber 20, a replenishment tank 15 that replenishes carbon dioxide lacking in the washing chamber 20, a filter 43 that separates pollutants from the carbon dioxide discharged after use, a distillation chamber 45 that distills the carbon dioxide discharged after use, a contamination chamber 47 that stores the contaminants filtered in the distillation chamber 45, a cooler 44 that liquefies the distilled carbon dioxide, a compressor 48 that depressurizes the pressurized washing chamber, and a purge valve 49 that reduces a pressure of the washing chamber 20.

In some examples, the laundry treating apparatus can further include a plurality of pipes for connecting the components with each other and a plurality of valves or controllers for controlling a flow of carbon dioxide along the plurality of pipes. Because FIG. 1 schematically shows each component, the plurality of valves or controllers are omitted, and the plurality of pipes are indicated by lines.

A triple point of carbon dioxide ($CO_2$) is known to be 5.1 atmospheres (atm) and −56.6 degrees Celsius (° C.). Thus, a phase change from a solid (dry ice) to a gas occurs when a temperature changes under an atmospheric pressure below the triple point. However, under a pressure higher than the triple point, because carbon dioxide exists as the liquid and the gas, a phase change between the liquid and the gas can occur depending on given pressure and temperature.

Therefore, when carbon dioxide is pressurized, similar to using water as the cleaning solvent in a general laundry treating apparatus, liquid carbon dioxide ($CO_2$(L) or L-$CO_2$) can be used as the cleaning solvent. However, in a case of a water-soluble substance, because washing power using carbon dioxide is low, a detergent or a surfactant for removing the water-soluble substance can be additionally used.

A fluid other than carbon dioxide can be used as the cleaning solvent. When the fluid is pressurized at a predetermined temperature, a phase change of the fluid from the gas to the liquid can occur or the fluid can be in a supercritical fluid state.

When carbon dioxide is used as the cleaning solvent, and when the pressure is reduced to the atmospheric pressure after the washing cycle is completed, all carbon dioxide evaporates into the gas, so that there is no need to separately go through a drying cycle for a long time, and there is no smell even when there is residual carbon dioxide. However, because carbon dioxide is used under pressure, unlike a tub of a general laundry treating apparatus, a sealed pressure vessel may be provided to help to prevent carbon dioxide from leaking.

Therefore, the washing chamber 20, which is the sealed vessel from which pressurized carbon dioxide is not able to escape, should be constructed as a pressure vessel or a pressure-resistant vessel that withstands the pressure of the pressurized carbon dioxide. This is also applied for the storage tank 10, the replenishment tank 15, and the distillation chamber 45.

FIGS. 2A to 4B show example stages of a washing cycle of the laundry treating apparatus in FIG. 1.

Figure 2A:
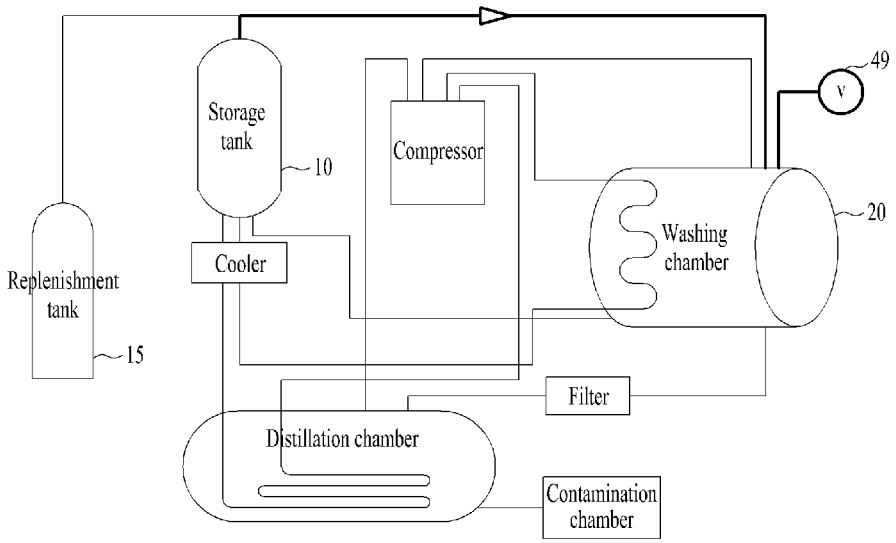
FIG. 2A shows an example of a preparation operation prior to starting a washing process during a washing cycle of the laundry treating apparatus.

FIG. 2A shows an example of a preparation operation prior to starting a washing process during a washing cycle of a laundry treating apparatus using carbon dioxide as a cleaning solvent. When the user selects the washing cycle, first the purge valve 49 is opened and the air inside the washing chamber 20 is removed using a vacuum pump. This is because, when moisture is contained, the washing power of carbon dioxide for the laundry can be reduced.

Thereafter, first, a top of the storage tank 10 is opened to supply gaseous carbon dioxide to the washing chamber 20 to pressurize the washing chamber 20. The storage tank 10 can distill previously used carbon dioxide and store the distilled carbon dioxide. The storage tank 10 is also the pressure vessel. A portion of carbon dioxide can be stored as gaseous carbon dioxide, and the remaining portion thereof can be stored as liquid carbon dioxide. Therefore, gaseous carbon dioxide can be supplied to the washing chamber 20 by opening the top of the storage tank 10.

In some examples, gaseous carbon dioxide will be supplied to the washing chamber 20 until pressure equilibrium between the storage tank 10 and the washing chamber 20 is achieved. Therefore, a pressure of the storage tank 10 will decrease, which will also decrease a temperature of the storage tank 10. In the storage tank 10, gaseous carbon dioxide and liquid carbon dioxide coexist. When liquid carbon dioxide is put into the washing chamber 20 in a near vacuum state, as all of liquid carbon dioxide vaporizes, the temperature will drop rapidly as to damage the laundry. To prevent this, gaseous carbon dioxide can be injected first.

Figure 2B:
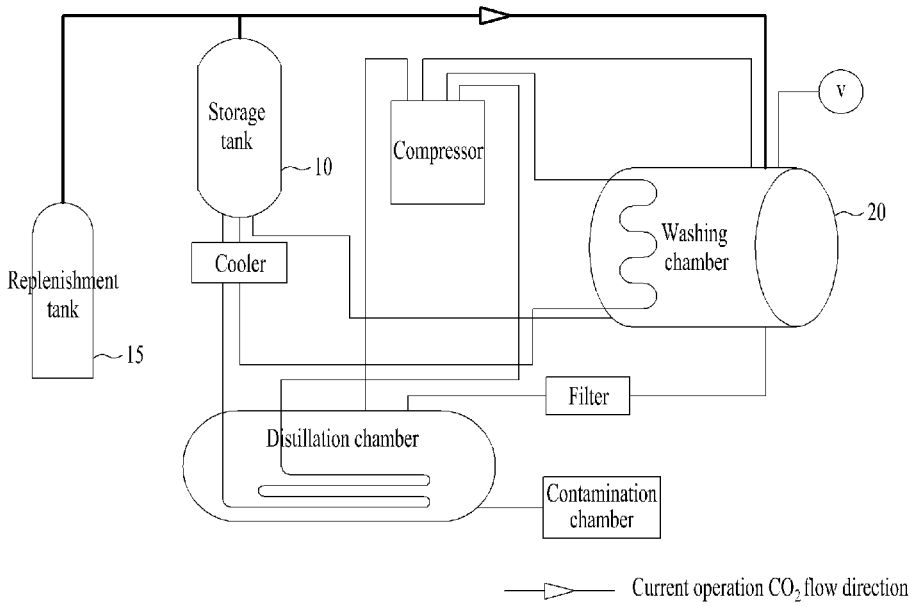
FIG. 2B shows an example of a pressurization operation of supplying liquid carbon dioxide to a washing chamber after the preparation operation.

FIG. 2B shows an example of a pressurization operation of supplying liquid carbon dioxide to the washing chamber 20 after the preparation operation is completed or during the preparation operation. The liquid carbon dioxide is stored in the replenishment tank 15, and the replenishment tank 15 is opened to supply the liquid carbon dioxide to the washing chamber 20. The storage tank 10 distills and stores most of the carbon dioxide used last time, but carbon dioxide remaining in the washing chamber 20 is discharged to the outside in a final operation to be described later, so that carbon dioxide is lost to some extent. To supplement this, the replenishment tank 15 is used. In some examples, liquid carbon dioxide is filled in the replenishment tank 15, and the liquid carbon dioxide is able to be supplied to the washing chamber 20.

Figure 3A:
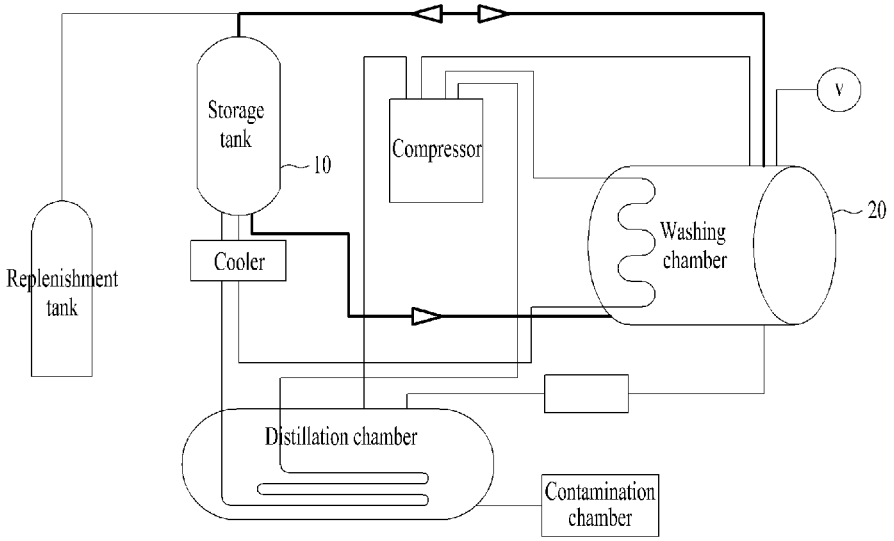
FIG. 3A shows an example process of supplying carbon dioxide to a washing chamber using a vertical level difference between a storage tank and the washing chamber after a pressurization operation is completed, and a washing process of removing foreign substances in laundry using carbon dioxide.

FIG. 3A shows an example process of supplying carbon dioxide to a washing chamber using a vertical level difference between a storage tank and the washing chamber after a pressurization operation is completed, and a washing process of removing foreign substances in laundry using carbon dioxide.

After the preparation operation and the pressurization operation are completed, the washing chamber 20 will maintain a predetermined atmospheric pressure, for example 50 bar. In some examples, liquid carbon dioxide and gaseous carbon dioxide will coexist in the washing chamber 20. However, in order to secure sufficient liquid carbon dioxide for washing, a bottom of the storage tank 10 is opened to supply liquid carbon dioxide. In some examples, the liquid carbon dioxide is supplied by a vertical level difference between the washing chamber 20 and the storage tank 10, not by a pressure. In some examples, gaseous carbon dioxide communicates the top of the storage tank 10 and the washing chamber 20 with each other. This is indicated by a bidirectional arrow on a flow path of carbon dioxide in FIG. 3A.

After liquid carbon dioxide is filled in the washing chamber 20 to a predetermined vertical level, the drum is rotated to perform a washing operation.

Figure 3B:
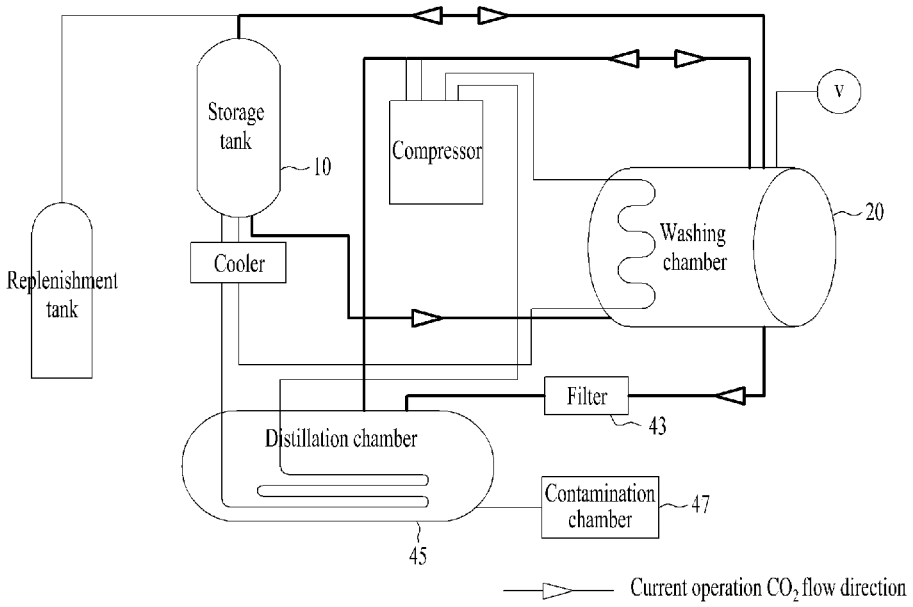
FIG. 3B shows an example of a rinsing preparation operation of recovering liquid carbon dioxide inside a washing chamber by supplying carbon dioxide to the washing chamber using a vertical level difference between a storage tank and the washing chamber after washing is completed and prior to performing a rinsing process.

FIG. 3B shows an example of a rinsing preparation operation of recovering liquid carbon dioxide inside the washing chamber 20 by supplying carbon dioxide to the washing chamber 20 using the vertical level difference between the storage tank 10 and the washing chamber 20 after the washing is completed and prior to performing rinsing.

Liquid carbon dioxide used in the washing chamber 20 can contain contaminants separated from the laundry. Liquid carbon dioxide discharged from the washing chamber 20 to remove the contaminants is supplied into the distillation chamber 45 through the filter 43.

Liquid carbon dioxide discharged from the washing chamber 20 will be discharged to the distillation chamber 45 by a vertical level difference between the washing chamber 20 and the distillation chamber 45 rather than by a pressure difference. In some examples, for pressure equilibrium between components, by communicating the storage tank 10, the distillation chamber 45, and the washing chamber 20 with each other, gaseous carbon dioxide can freely flow between the storage tank 10, the distillation chamber 45, and the washing chamber 20. This is indicated by a bidirectional arrow on the flow path of carbon dioxide.

Liquid carbon dioxide discharged after the use in the washing chamber 20 fills the distillation chamber 45. Instead of the discharged liquid carbon dioxide, clean liquid carbon dioxide supplied from the bottom of the storage tank 10 will fill an empty space in the washing chamber 20.

Figure 4A:
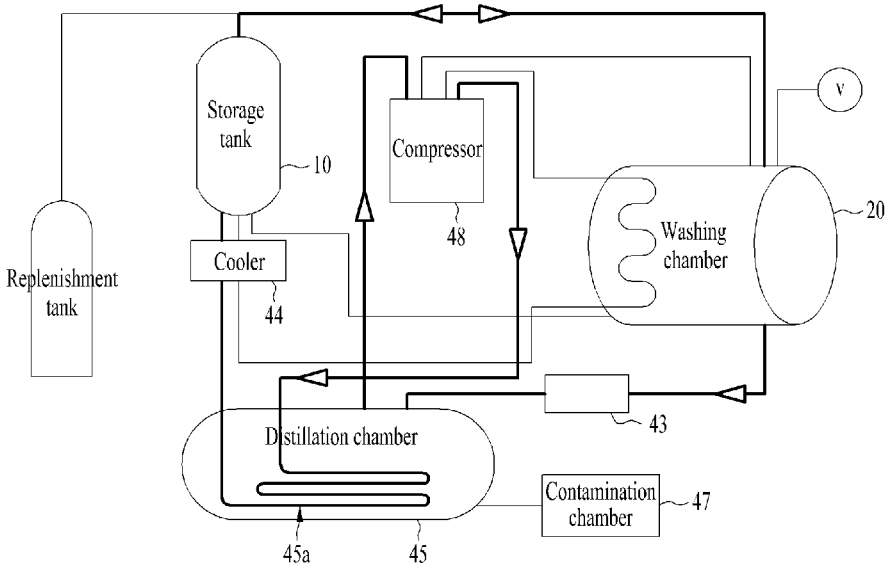
FIG. 4A shows an example of a rinsing process and a rinsing/distillation operation of distilling liquid carbon dioxide discharged to a distillation chamber.

FIG. 4A shows an example of a rinsing process and a rinsing/distillation operation of distilling liquid carbon dioxide discharged to a distillation chamber.

When the rinsing preparation operation is terminated, a rinsing operation of separating the remaining contaminants by rotating the drum is performed.

During the rinsing operation or after the rinsing operation is completed, distillation of carbon dioxide can be performed in the distillation chamber 45. An air intake portion of the compressor 48 can be connected to the distillation chamber 45, and an exhaust portion of the compressor 48 that discharges a compressed fluid can be connected to a distillation pipe 45*a* disposed in the distillation chamber 45. A flow direction of such carbon dioxide will be adjusted based on opening and closing of a valve.

When the compressor 48 operates, a pressure inside the distillation chamber 45 is dropped, so that liquid carbon dioxide will be vaporized. The vaporized carbon dioxide will be compressed through the compressor 48 and pass through the distillation pipe 45*a* in a high-temperature and high-pressure state. The vaporization can occur more easily in liquid carbon dioxide inside the distillation chamber 45 through a heat exchange to a certain extent in the distillation pipe 45*a*. In some examples, gaseous carbon dioxide that has passed through the distillation pipe 45*a* can be liquefied through the cooler 44 (or the condenser) and be introduced into the storage tank 10.

When liquid carbon dioxide inside the distillation chamber 45 is vaporized and flows to the compressor 48, an empty space of the distillation chamber 45 will be filled by the flowed liquid carbon dioxide of the washing chamber 20 by a vertical level difference.

In some examples, because foreign substances are not vaporized when liquid carbon dioxide is vaporized in the distillation chamber 45, the foreign substances can be moved to and stored in the contamination chamber 47.

Figure 4B:
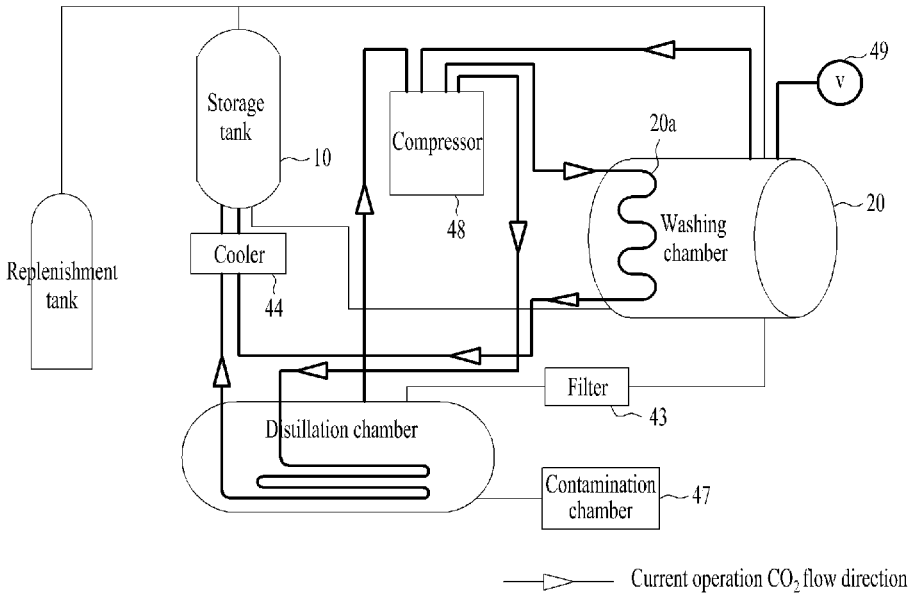
FIG. 4B shows an example of a recovery/distillation operation of recovering gaseous carbon dioxide inside a washing chamber and removing residual gas after a rinsing process is completed.

FIG. 4B shows an example of a recovery/distillation operation of recovering gaseous carbon dioxide inside a washing chamber and removing residual gas after a rinsing process is completed.

The distillation operation can be performed in the rinsing operation, and can be performed simultaneously in the recovery operation. Although liquid carbon dioxide has flowed to the distillation chamber 45, carbon dioxide that has not yet been distilled remains in the distillation chamber 45. Therefore, the distillation operation is to distill the remaining carbon dioxide.

The air intake portion of the compressor 48 can be connected to the distillation chamber 45, and the exhaust portion of the compressor 48 that discharges the compressed fluid can be connected to the distillation pipe 45*a* disposed inside the distillation chamber 45. The flow direction of such carbon dioxide will be adjusted based on the opening and the closing of the valve.

When the compressor 48 operates, the pressure inside the distillation chamber 45 is dropped, so that liquid carbon dioxide will be vaporized. The vaporized carbon dioxide will be compressed through the compressor 48 and pass through the distillation pipe 45*a* in the high-temperature and high-pressure state. The vaporization can occur more easily in liquid carbon dioxide inside the distillation chamber 45 through the heat exchange to the certain extent in the distillation pipe 45*a*. In some examples, gaseous carbon dioxide that has passed through the distillation pipe 45*a* can be liquefied through the cooler 44 (or the condenser) and be introduced into the storage tank 10.

As described above, the distillation operation refers to an operation of vaporizing liquid carbon dioxide in the washing chamber 20 to remove the foreign substances from the carbon dioxide and then storing the purified liquid carbon dioxide in the storage tank. In contrast, the recovery operation refers to an operation of recovering gaseous carbon dioxide existing inside the washing chamber 20 and storing the carbon dioxide in the storage tank 10 after the compression. This is because gaseous carbon dioxide does not need to pass through the filter 43 or be distilled as gaseous carbon dioxide does not mix with the foreign substances.

For example, the air intake portion of the compressor 48 can be connected to a top of the washing chamber 20, and gaseous carbon dioxide located inside the washing chamber 20 can pass through a chamber heat exchange tube 20*a* located inside the washing chamber 20, then, be liquefied through the cooler 44, and then, stored in the storage tank 10. The flow direction of such carbon dioxide will be adjusted based on the opening and the closing of the valve.

The reason that gaseous carbon dioxide inside the washing chamber 20 passes through the chamber heat exchange tube 20*a* after being compressed through the compressor 48 is because gaseous carbon dioxide can be liquefied when the pressure of the washing chamber 20 drops and thus the temperature of the washing chamber 20 drops as gaseous carbon dioxide is suctioned into the compressor 48. To prevent this, the temperature in the washing chamber 20 is maintained at a certain temperature, for example, 20 degrees (° C.).

In some examples, when the pressure inside the washing chamber 20 drops to a pressure equal to or lower than a certain pressure, for example, 1.5 bar, finally, the purge valve 49 will be opened to discharge the remaining gaseous carbon dioxide. This can cause the storage tank to lose some carbon dioxide supplied during the washing cycle. Therefore, as described above, the replenishment tank 15 can be included to replenish the carbon dioxide that is insufficient in a next washing cycle.

As described above, the washing cycle of the laundry treating apparatus can include the storage tank 10, the distillation chamber 45, the compressor 48, and the cooler 44 for the distillation operation and the recovery operation as well as the washing chamber 20. The laundry treating apparatus also includes the replenishment tank 15 for replenishing the lost carbon dioxide.

In some examples, the storage tank 10, the distillation chamber 45, and the washing chamber 20 should be designed as the pressure vessels or the pressure-resistant vessels to accommodate liquid carbon dioxide therein. Therefore, the several pressure vessels may be installed in a relatively large installation space by increasing a volume of the laundry treating apparatus. In some examples, because a weight of the apparatus increases, a reinforcement work of solidifying a floor of an installation space may be provided. In some examples, there is a problem in that the pipe connection between such components becomes very complicated, and thus the volume of the laundry treating apparatus increases.

The present disclosure relates to a laundry treating apparatus that is miniaturized and has simplified pipe connection while using carbon dioxide as the cleaning solvent.

Figure 5:
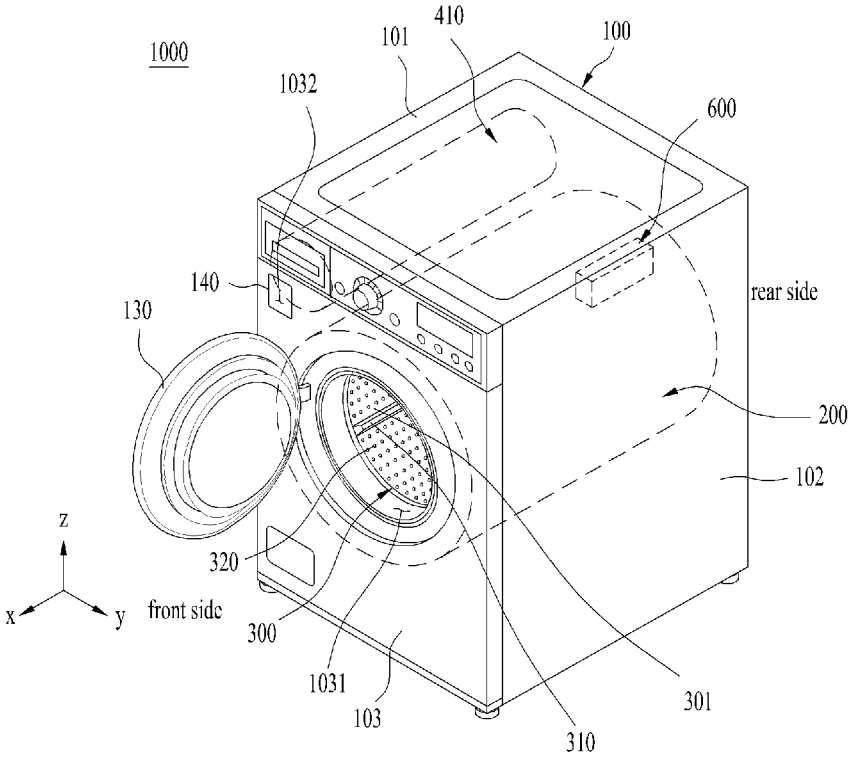
FIG. 5 shows an example of a laundry treating apparatus.

FIG. 5 shows an example of a laundry treating apparatus 1000 described in the present disclosure. Referring to FIG. 5, the laundry treating apparatus 1000 includes a pressure vessel 200 that maintains fluid accommodated therein at a pressure higher than the atmospheric pressure, a separator 250 that separates the pressure vessel 200 into a first chamber 210 (see FIG. 7) and a second chamber 220 (see FIG. 7), a drum 300 that is rotatably disposed in the first chamber 210 to accommodate the laundry therein, a driver 500 that rotates the drum 300, and a transferring member 490 that transfers the fluid between the first chamber 210 and the second chamber 220.

Therefore, a feature of the present disclosure is to separate an interior of one pressure vessel 200 into the first chamber 210, which is a space for treating the laundry using liquid carbon dioxide, and the second chamber 220, which is a space for storing liquid carbon dioxide, using the separator 250.

The second chamber 220 can store purified liquid carbon dioxide after removing the contaminants from the liquid carbon dioxide used in the first chamber 210. In some examples, the purified liquid carbon dioxide can be used by being supplied to the first chamber 210 again.

The laundry treating apparatus 1000 can further include a cabinet 100 that forms an appearance thereof, and the pressure vessel 200 can be disposed inside the cabinet 100.

In some examples, the laundry treating apparatus 1000 can further include a supplying member 410 (see FIG. 17) that stores the fluid and supplies the fluid to the first chamber 210, and a purifier 440 (see FIG. 17) that removes the mixed contaminants from the fluid discharged from the first chamber 210.

The supplying member 410 can supply the fluid to the first chamber 210 before the drum 300 rotates at a preset first rotation speed. This can initiate the washing cycle.

The fluid can be carbon dioxide. When carbon dioxide is used as the cleaning solvent, an effect similar to dry cleaning using an organic solvent, such as perchlorethylene (PCE), can be obtained. Here, detergent containing the surfactant can be mixed and used with carbon dioxide.

Hereinafter, the present disclosure has been described on the premise that carbon dioxide is used as an example of the fluid, but other cleaning solvents other than carbon dioxide can be used.

The washing cycle can include a series of cycles or courses performed by the laundry treating apparatus when the user selects a course for washing the laundry. The washing cycle includes a washing operation S200 (see FIG. 23), a first rinsing operation S500 (see FIG. 23) and an exhaust operation S900 (see FIG. 23).

In some examples, the washing cycle can include a first supply operation S100 (see FIG. 23) prior to the washing operation. In some examples, between the washing operation S200 (see FIG. 23) and the first rinsing operation S500 (see FIG. 23), a first purification operation S300 (see FIG. 23) and a second supply operation S400 (see FIG. 23) can be included.

Figure 23:
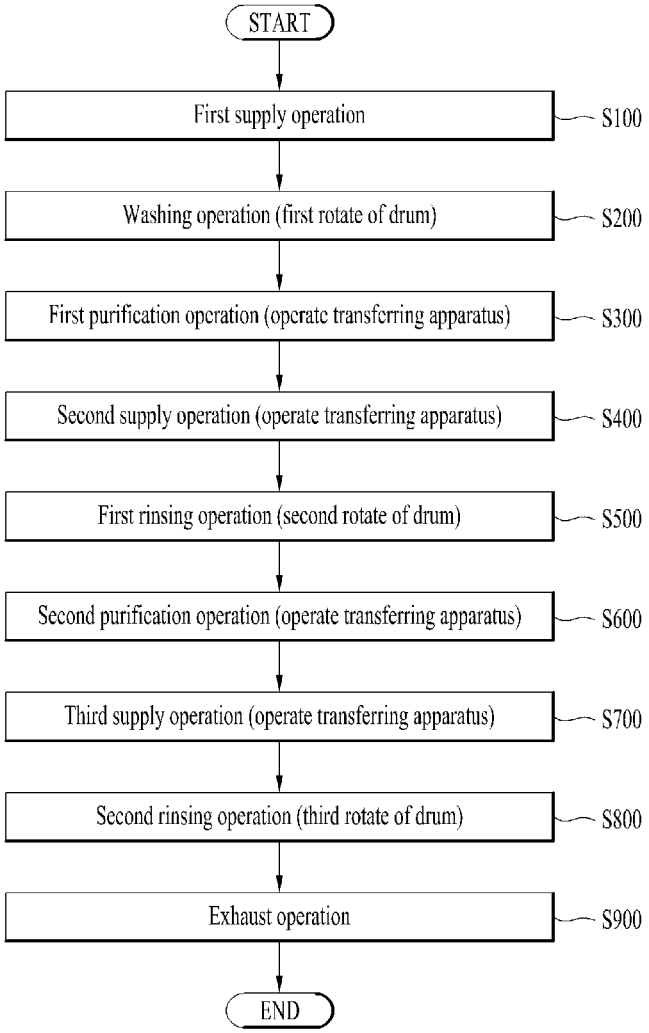
FIG. 23 is a flowchart showing an example of a method for controlling a washing cycle.

In some examples, the washing cycle can further include a second purification operation S600 (see FIG. 23), a third supply operation S700 (see FIG. 23), and a second rinsing operation S800 (see FIG. 23) between the first rinsing operation S500 (see FIG. 23) and the exhaust operation S900 (see FIG. 23).

The cabinet 100 can include a cabinet bottom part (or a bottom part of the cabinet) that forms a bottom side of the laundry treating apparatus 1000, a top panel 101 that forms a top part of the cabinet 100, a front panel 103 that forms a front part of the cabinet 100 and connects the cabinet bottom part and the top panel 101 to each other, side panels 102 that form both side sides of the cabinet 100 and connect the cabinet bottom part and the top panel 101 to each other, and a rear panel that forms a rear part of the cabinet.

The front panel 103 can have a cabinet inlet 1031 defined therein through which the laundry can be put into the drum 300 or the laundry accommodated in the drum 300 can be withdrawn to the outside of the cabinet 100. In some examples, the laundry treating apparatus 1000 can include a door 130 pivotably disposed on the front panel 103 to open and close the cabinet inlet 1031.

The pressure vessel 200 can be positioned inside the cabinet 100 to accommodate carbon dioxide therein. The pressure vessel 200 can include a chamber inlet 219 (see FIG. 6) defined therein capable of communicating with the cabinet inlet. When the door 130 is closed, not only the cabinet inlet, but also the chamber inlet can be closed, so that the pressure vessel 200 can be the pressure vessel or the pressure-resistant vessel capable of accommodating high-pressure carbon dioxide therein. For example, carbon dioxide supplied to the pressure vessel 200 can maintain a predetermined pressure to exist as liquid carbon dioxide. In some implementations, the pressure can be a pressure set in a pressure range from 45 bar to 51 bar.

The drum 300 can be rotatably disposed inside the pressure vessel 200. Specifically, the drum 300 can be rotatably disposed inside the first chamber 210. The drum 300 can include a plurality of side through-holes 320 defined in an inner circumferential surface of the drum 300 to allow fluid communication between the pressure vessel 200 and the drum 300. That is, the drum 300 can include a drum body 301 for accommodating the laundry therein, and the plurality of side through-holes 320 penetrating a side of the drum body. Carbon dioxide supplied to the pressure vessel 200, specifically the first chamber 210 (see FIG. 7), through the plurality of side through-holes 320 can flow into an accommodation space 302 (see FIG. 7), which is a space in which the laundry is accommodated inside the drum body, or exit from the accommodation space to a space between the first chamber 210 (see FIG. 7) and the drum 300.

The drum 300 can have a cylindrical shape. Alternatively, the drum body 301 that forms an outer shape of the drum 300 can have a cylindrical shape.

Referring to FIG. 5, the laundry treating apparatus 1000 can include the pressure vessel 200 that accommodates a fluid having a pressure higher than the atmospheric pressure, the separator 250 that separates an interior of the pressure vessel 200 into the first chamber 210 (see FIG. 7) in which the drum 300 in the cylindrical shape for accommodating the laundry therein is disposed, and the second chamber 220 (see FIG. 7) for storing the fluid therein, the plurality of side through-holes 320 defined through the side of the drum 300 such that the fluid can communicate, the driver 500 that rotates the drum 300, and the transferring member 490 that transfers the fluid between the first chamber 210 and the second chamber 220.

Although the plurality of side through-holes 320 are omitted in the drawings after FIG. 5 when illustrating the drum 300, the plurality of side through-holes 320 are defined in the side of the drum body 301.

In some examples, the drum 300 can further include a drum inlet 319 (FIG. 12) defined as one side of the drum body 301 is opened to communicate with the cabinet inlet 1031 and the chamber inlet 219.

The drum 300 can further include a lifter 310 positioned on an inner circumferential surface of the drum body 301 and directed along an axial direction of the drum body 301. The lifter 310 can serve to lift the laundry during the rotation of the drum 300 and then drop the laundry by gravity. Therefore, it is possible to prevent the laundry from being twisted and agglomerated during the washing or the rinsing.

In some examples, the cabinet inlet 1031 and the chamber inlet 219 are connected to each other through an insulating portion. The insulating portion can help to prevent carbon dioxide stored in the pressure vessel 200 from leaking out of the cabinet 100 through the chamber inlet 219, and damping transmission of vibration of the pressure vessel 200 to the cabinet 100.

The driver 500 (see FIG. 6) can be disposed inside the pressure vessel 200. The driver 500 can include a motor 510 (see FIG. 7) that generates a rotation force, and a rotation shaft 519 (see FIG. 6) that is connected to the drum and transmits the rotation force of the motor.

The supplying member 410 (see FIG. 17) can store carbon dioxide therein and supply carbon dioxide to the first chamber 210. The supplying member 410 can include a flow rate regulator 461 (see FIG. 17) for supplying carbon dioxide stored in the supplying member 410 to the first chamber 210. The flow rate regulator 461 can be coupled to the supplying member 410, but the flow rate regulator 461 can also be located on a pipe connecting the supplying member 410 and the pressure vessel 200 to each other.

In some examples, the flow rate regulator 461 can be a valve capable of only opening and closing a pipe between the supplying member 410 and the first chamber 210. This is because the supplying member 410 and the first chamber 210 are able to reach the pressure equilibrium by opening the flow rate regulator 461 without a need for the first chamber 210 to reach a preset pressure.

The supplying member 410 can be a high-pressure tank, a reservoir, or a gas cylinder capable of storing gas and liquid carbon dioxide in a cylindrical shape therein. The front panel 103 can include an injection hole 1032 located below a control panel 190 and defined through the front panel 103 to supply carbon dioxide of the supplying member 410. In some examples, the front panel 103 can further include an injection protection cover 140 that opens and closes the injection hole 1032. When carbon dioxide stored in the supplying member is exhausted or the pressure falls to a pressure equal to or lower than the preset internal pressure, by opening the injection protection cover 140 and accessing the supplying member through the injection hole 1032, fresh carbon dioxide can be charged into the supplying member 410.

Referring to FIG. 5, the supplying member 410 can be located diagonally above the pressure vessel 200 rather than vertically above the pressure vessel 200. This is because it is advantageous for the supplying member 410 to be located diagonally above the pressure vessel 200 rather than vertically above the pressure vessel 200 to efficiently use the space inside the cabinet 100 considering that both the pressure vessel 200 and the supplying member 410 have circular external shapes.

In some implementations, unlike FIG. 5, after all carbon dioxide is exhausted or the tank of the supplying member 410 whose pressure has fallen to the pressure equal to or lower than the preset internal pressure is withdrawn, a newly charged tank can be used. Alternatively, the supplying member 410 can be located diagonally below the pressure vessel 200. In some examples, the supplying member 410 can be erected vertically instead of lying horizontally.

In some examples, the supplying member 410 can be located outside the cabinet 100. The supplying member 410 and the first chamber 210 can be connected to each other through a pipe that extends the outside to the inside of the cabinet.

The control panel 190 can be disposed at an upper portion of the front panel 103. The control panel 190 can receive a user's input and display a state of the laundry treating apparatus for the user. The input information received from the control panel 190 can be transmitted to the controller 600, and the controller 600 can display the state of the laundry treating apparatus on the control panel 190.

In some examples, the controller 600 can control the rotation and stop of the rotation of the drum 300 through the driver 500 based on the input information.

In some examples, the controller 600 can control the flow and the flow direction of carbon dioxide. The controller 600 can allow liquid carbon dioxide discharged from the first chamber 210 to pass through the purifier 440 through the transferring member 490 to remove contaminants mixed in the liquid carbon dioxide, then store the liquid carbon dioxide in the second chamber 220, and then supply the liquid carbon dioxide stored in the second chamber 220 to the first chamber 210 while performing the washing cycle.

In one example, the laundry treating apparatus 1000 can include the flow rate regulator 461 between the supplying member 410 and the first chamber 210. In some examples, the laundry treating apparatus 1000 can have valves between the first chamber 210 and the purifier 440, between the first chamber 210 and the second chamber 220, and between the second chamber 220 and the transferring member 490. In some examples, an exhaust valve 463 can be disposed in an exhaust portion 480 (see FIG. 17) that is connected to the first chamber and communicates carbon dioxide accommodated in the first chamber with the outside. The flow rate regulator 461 and the valves can be opened and closed by the controller 600, which will be described later with reference to FIGS. 17 to 22.

FIG. 5 shows that the controller 600 is positioned at a corner where the top panel 101 and the side panel 102 meet. However, this is only an example. The controller 600 can be located inside the cabinet 100 corresponding to the position of the control panel 190 on the front panel 103. In some examples, the controller 600 can be located anywhere as long as the controller 600 is able to control the laundry treating apparatus 1000.

Figure 6:
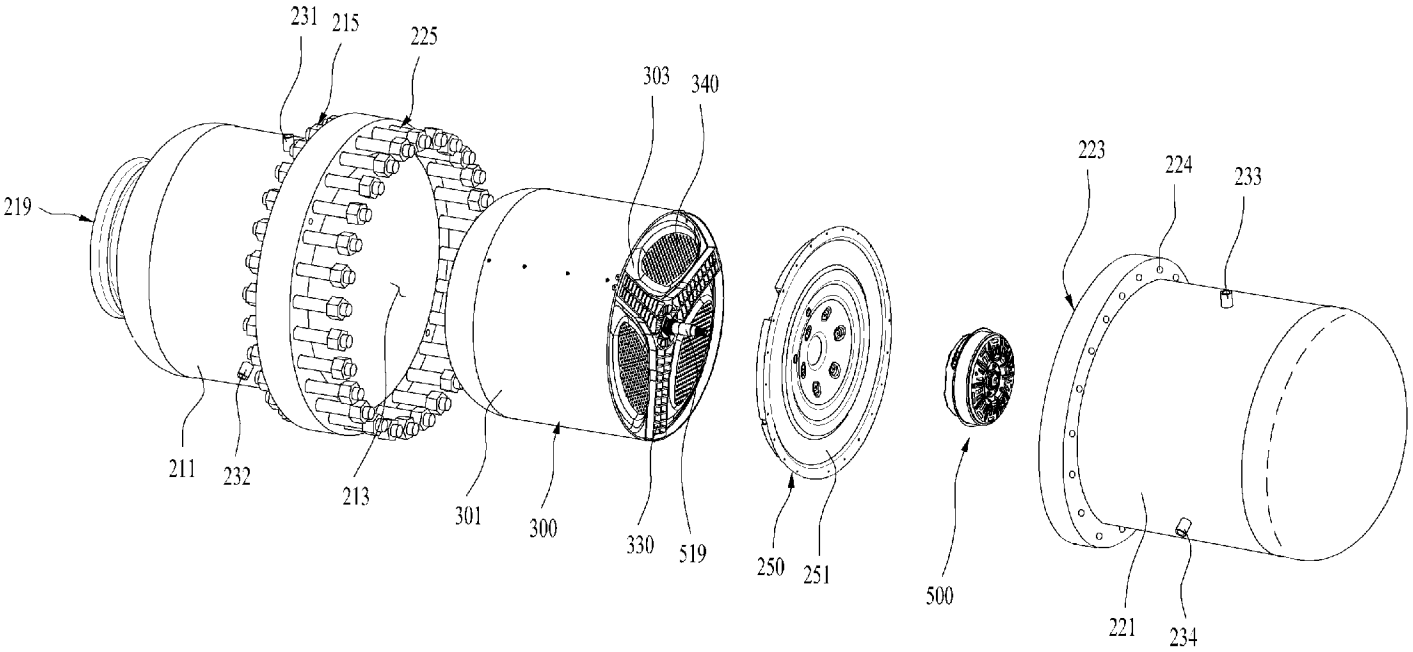
FIG. 6 is an exploded view of an example of a pressure vessel included in the laundry treating apparatus in FIG. 5.

FIG. 6 is an exploded view of an example of the pressure vessel 200 included in the laundry treating apparatus 1000 described in the present disclosure. The pressure vessel 200 can include the chamber inlet 219 in communication with the cabinet inlet 1031. The interior of the pressure vessel 200 can include the separator 250 that separates the pressure vessel 200 into the first chamber 210 and the second chamber 220.

The pressure vessel 200 can include the first housing 211 that includes the chamber inlet 219 and a first opening 213 facing away from the chamber inlet 219 defined therein and accommodates the drum 300 inside the pressure vessel 200, and the second housing 221 that has one side including a second opening 223 defined therein. The pressure vessel 200 can form the outer shape of the pressure vessel 200 by combining the first opening 213 and the second opening 223 to each other.

The outer shape of the pressure vessel 200 can be a shape in which both ends of a circular pipe are closed with curved surfaces. This is because the pressure vessel 200 is a pressure vessel that must withstand a pressure higher than the atmospheric pressure caused by the carbon dioxide accommodated therein. In the case of the pressure vessel, stress concentration or stress resulted from asymmetry does not occur when a cross-section thereof is in a smooth circular shape.

The separator 250 can include a support plate 251 that separates the pressure vessel 200 into the first chamber 210 and the second chamber 220. The drum 300 can be positioned in the first chamber 210 with respect to the separator 250 and rotatably coupled to the support plate 251. The driver 500 can be located in the second chamber 220, so that a rotation shaft 519 of the driver 500 can pass through the support plate to be connected to the drum 300.

The drum 300 can further include a drum rear part 303 that is a rear part of the drum body 301 directed in a direction toward the support plate 251 of the drum body 301, and bottom through-holes 340 that pass through the drum rear part 303.

In one example, when rotating the drum 300 by connecting only a center of the drum rear part 303 to the rotation shaft 519, a connection portion of the drum 300 and the rotation shaft 519 is easily damaged by a torsion. To prevent this, the drum 300 can include a rotation support 330 that includes a plurality of wings extending from the center of the drum rear part 303 to the side of the drum body 301 along a radial direction of the drum rear part 303 and is fixedly coupled to the drum rear part 303. The rotation shaft 519 is connected to the rotation support 330 to allow the rotation force of the rotation shaft 519 to be transmitted to the entire drum body 301 to rotate the entire drum body 301, not rotating only the center of the drum rear part 303.

Referring to FIG. 6, the support plate can be coupled to the first housing 211 by being positioned in the first opening 213 or adjacent to the first opening 213. Alternatively, the support plate can be coupled to the second housing 221 by being positioned in the second opening 223 or adjacent to the second opening 223.

The support plate 251 can eventually support the driver 500 and support the drum 300.

For example, the support plate 251 can be made of a metal material having a predetermined thickness. In some examples, the support plate 251 can support a heat exchanger 256 and a heat insulator 259 to be described later.

Accordingly, the first housing 211 and one of both sides of the support plate 251 facing the chamber inlet can form the first chamber 210, and the second housing 221 and the other of both sides of the support plate 251 facing the second housing 221 can form the second chamber 220.

An outer circumferential surface of the first housing 211 can include a first communication hole 241 defined through the first housing 211 to supply carbon dioxide. In some examples, a first connector 231 to be connected to a pipe that connects the supplying member 410 and the first chamber 210 to each other and/or a pipe that connects the first chamber 210 and the second chamber 220 to each other can be included. The first connector 231 can have a shape of a pipe that surrounds the first communication hole 241 and protrudes.

In some examples, the outer circumferential surface of the first housing 211 can include a second communication hole 242 defined through the first housing 211 to discharge carbon dioxide accommodated in the first chamber 210. In some examples, a second connector 232 to be connected to the pipe that connects the first chamber 210 and the second chamber 220 to each other and/or a pipe that connects the first chamber 210 and the transferring member 490 to each other can be included. The second connector 232 can have a shape of a pipe that surrounds the second communication hole 242 and protrudes.

The outer circumferential surface of the second housing 221 can include a first hole 243 defined through the second housing 221 to supply carbon dioxide. In some examples, a first protruding end 233 to be connected to the pipe that connects the first chamber 210 and the second chamber 220 to each other and/or the pipe that connects the first chamber 210 and the transferring member 490 to each other can be included. The first protruding end 233 can have a shape a pipe that surrounds the first hole 243 and protrudes.

In some examples, the outer circumferential surface of the first housing 211 can include a second hole 244 defined therethrough to discharge carbon dioxide accommodated in the second chamber 220. In some examples, a second protruding end 234 connected to the pipe that connects the second chamber 220 and the transferring member 490 to each other can be included. The second protruding end 234 can have a shape of a pipe that surrounds the second hole 244 and protrudes.

In one example, the first housing 211 can further include a first flange 212 that is bent at one end of the first housing 211 where the first opening 213 is located and extends in a radial direction away from a center of the first opening 213.

Similarly, the second housing 221 can further include a second flange 222 that is bent at one end of the second housing 221 where the second opening 223 is located and extends in a radial direction away from a center of the second opening 223.

The first flange 212 and the second flange 222 can be used to couple the first chamber 210 and the second chamber 220 to each other to form the pressure vessel 200.

In some examples, the first flange 212 can include a support plate coupling portion 2121 coupled to the support plate 251. The support plate coupling portion 2121 can be formed by recessing a portion corresponding to an outer diameter of the support plate 251 in the first flange 212 by a thickness equal to or greater than a thickness of the support plate 251. Through this, the first flange 212 can have a stepped structure. This is to avoid interference with the support plate 251 when the first flange 212 and the second flange 222 are coupled to each other.

The outer diameter of the support plate can be larger than a diameter of the first opening 213 but smaller than an outer diameter of the first flange 212. Accordingly, a portion closer to the first opening 213 than an outer portion of the first flange 212 parallel to the axial direction of the drum 300 in the first flange 212 can be recessed along the circumferential direction to define the support plate coupling portion 2121.

The first flange 212 can further include a plurality of first flange through-holes 214 (see FIG. 8) that are aligned along a circumferential direction of the first flange and penetrate the first flange 212 along a rotation shaft direction to couple the first housing 211 and the second housing 221 to each other at a location between the outer diameter of the first flange 212 and the outer diameter of the support plate coupling portion 2121. Similarly, the second flange 222 can further include a plurality of second flange through-holes 224 that are aligned along a circumferential direction of the second flange and penetrate the second flange 222 along the rotation shaft direction at locations corresponding to the plurality of first flange through-holes 214. The number of plurality of first flange through-holes 214 and the number of plurality of second flange through-holes can be the same.

In some examples, in order to screw the first housing 211 and the second housing 221 to each other, after aligning the plurality of first flange through-holes 214 and the plurality of second flange through-holes 224 corresponding thereto to communicate with each other, each housing coupling bolt 215 can be inserted into each communicated flange through-hole, and then, the housing coupling bolt 215 can be coupled to a housing coupling nut 225. The number of housing coupling bolts 215 and the number of housing coupling nuts 225 can be the same as the number of plurality of first flange through-holes 214 or the number of plurality of second flange through-holes.

Figure 7:
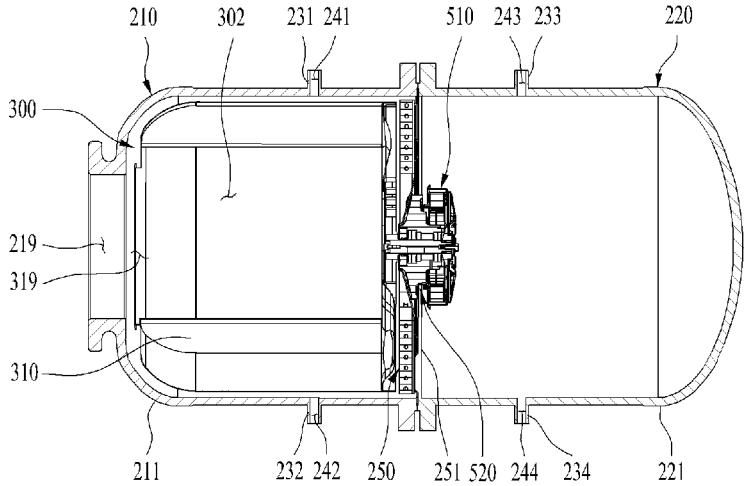
FIG. 7 shows a cross-section of an example of a pressure vessel.

FIG. 7 shows a cross-section of the pressure vessel 200. The pressure vessel 200 is formed as the first housing 211 and the second housing 221 are coupled to each other, and the separator 250 can separate the interior of the pressure vessel 200 into the first chamber 210 and the second chamber 220.

The drum 300 can be located inside the first chamber 210, and the chamber inlet 219 and the drum inlet 319 can communicate with each other. Therefore, it is possible to accommodate the laundry in the accommodation space 302 inside the drum 300.

The separator 250 can include the support plate 251 that is coupled to the first housing and separates the first chamber 210 and the second chamber 220 from each other. The driver 500 can be coupled to the support plate 251. The driver 500 can include a bearing housing assembly 520 that couples the support plate 251 and the motor 510 to each other and rotatably supports the motor 510. The bearing housing assembly 520 can be disposed between the support plate 251 and the motor 510.

The bearing housing assembly 520 and the driver 500 can be located on a side opposite to a side where the drum 300 is located, that is, in the second chamber 220, and the rotation shaft 519 can pass through the support plate 251 and be connected to the drum 300.

For the flow of carbon dioxide, the first connector 231, the second connector 232, the first protruding end 233, and the second protruding end 234 connected to the supplying member 410, the transferring member 490, the purifier 440, and the exhaust portion 480 (see FIG. 17) of the first chamber 210 and the second chamber 220 can be disposed on the outer circumferential surface of the pressure vessel 200. The first connector 231 and the second connector 232 can be disposed on an outer circumferential surface of the first housing 211. The first protruding end 233 and the second protruding end 234 can be disposed on an outer circumferential surface of the second housing 221. For the supply and the discharge of carbon dioxide, the first connector 231, the second connector 232, the first protruding end 233, and the second protruding end 234 can be formed in the pipe shape. Accordingly, the first communication hole 241 and the second communication hole 242 penetrating the first housing 211 can be defined at centers of the first connector 231 and the second connector 232, respectively. The first hole 243 and the second hole 244 penetrating the second housing 221 can be defined at centers of the first protruding end 233 and the second protruding end 234, respectively.

In some implementations, when the pressure vessel 200 is installed in the cabinet 100, with respect to the cabinet bottom part, the first connector 231 can be located higher than the second connector 232, and the first protruding end 233 can be located higher than the second protruding end 234.

Figure 8:
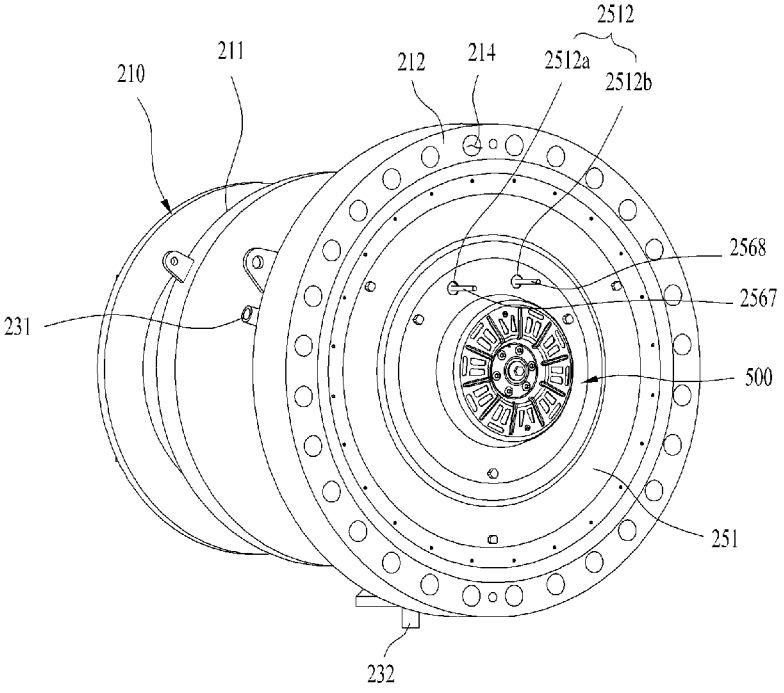
FIG. 8 shows an example of a second housing removed from the pressure vessel.

FIG. 8 shows the driver 500 and the support plate 251 after removing the second housing 221 from the pressure vessel 200. Referring to FIG. 8, the plurality of first flange through-holes 214 defined in the first flange 212 to couple the first housing 211 and the second housing 221 to each other can be aligned in the first flange 212 along a circumferential direction of the first flange 212.

The driver 500 can be supported by being coupled to the support plate 251. The support plate 251 can include a second through-hole 2512 defined to be spaced apart from the center of the support plate by a predetermined distance. This is to pass a first refrigerant pipe 2567 and a second refrigerant pipe 2568 for circulating a refrigerant to the heat exchanger to be described later. FIG. 8 shows that two second through-holes 2512*a* and 2512*b* are defined and the first refrigerant pipe 2567 and the second refrigerant pipe 2568 pass through the second through-holes 2512*a* and 2512*b*, respectively. However, this is only an example. In one example, after one second through-hole 2512 is defined, both the first refrigerant pipe 2567 and the second refrigerant pipe 2568 can pass through one second through-hole 2512. In some examples, two or more second through-holes 2512 can be defined.

In some examples, the second through-hole 2512 provides a passage through which gaseous carbon dioxide can flow in both directions for the pressure equilibrium between the first chamber 210 and the second chamber 220. As described above, in order for liquid carbon dioxide to exist at a room temperature, a high pressure can be provided, where the pressure vessel 200 is designed to withstand a high pressure higher than the atmospheric pressure, for example, 50 bar. Therefore, the support plate 251 present in the pressure vessel 200 must also have a sufficient thickness to withstand the high pressure.

In some cases, because the support plate 251 can be deformed by a pressure difference between the first chamber 210 and the second chamber 220, the pressures of the both chambers can be maintained in an equilibrium state using the second through-hole 2512 for the pressure equilibrium of the both chambers as gaseous carbon dioxide flows through the second through-hole 2512.

Figure 9:
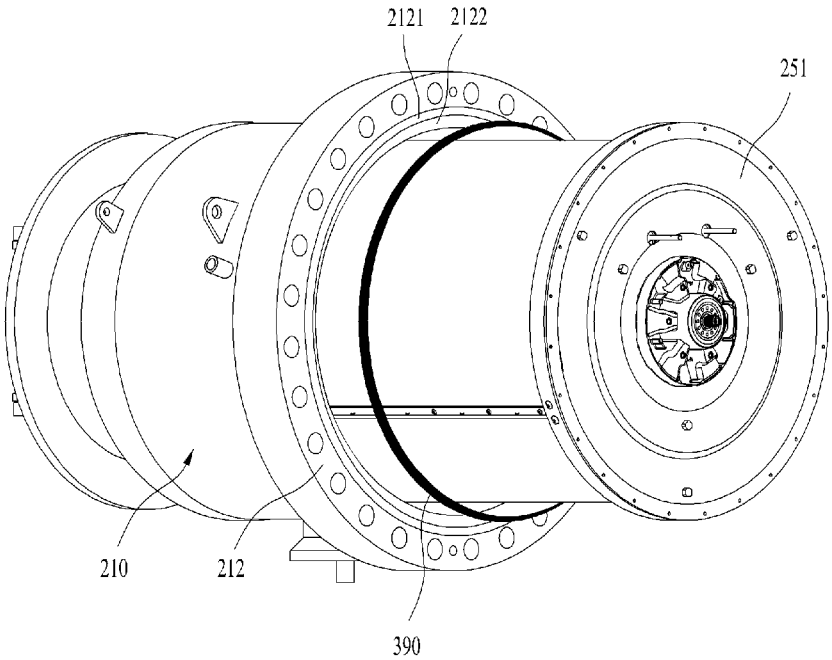
FIG. 9 shows an example portion of a drum removed through a first opening from a first housing.

FIG. 9 shows a state in which a portion of the drum 300 is removed through the first opening 213 from the first housing 211. The support plate coupling portion 2121 defined in the first flange 212 can be defined by recessing the portion corresponding to the outer diameter of the support plate 251 in the first flange 212 by the thickness equal to or greater than the thickness of the support plate 251. Through this, the first flange 212 can have the stepped structure. This is to avoid the interference with the support plate 251 when the first flange 212 and the second flange 222 are coupled to each other.

The outer diameter of the support plate 251 can be larger than a diameter of the first opening 213 but smaller than an outer diameter of the first flange 212. Accordingly, a portion closer to the first opening 213 than an outer portion of the first flange 212 parallel to the axial direction of the drum 300 in the first flange 212 can be recessed along the circumferential direction to define the support plate coupling portion 2121.

The pressure vessel 200 can further include a flange gasket 390 in a form of a ring. The support plate coupling portion 2121 can include a flange gasket insertion portion 2122 into which the flange gasket 390 can be inserted in order to prevent carbon dioxide from leaking between the first housing 211 and the support plate 251 or from flowing to the second chamber 220.

Because there is no difference in pressure between the first chamber 210 and the second chamber 220, the flange gasket 390 may not be fastened with an excessive fastening force because the flange gasket 390 simply blocks only the flow by the gravity without a need to block the flow of liquid carbon dioxide resulted from the pressure difference.

An outer diameter of the flange gasket 390 can be smaller than the outer diameter of the support plate 251 and larger than the diameter of the first opening 213. In some examples, the outer diameter of the flange gasket 390 can be larger than the outer diameter of the drum body 301.

Figure 10:
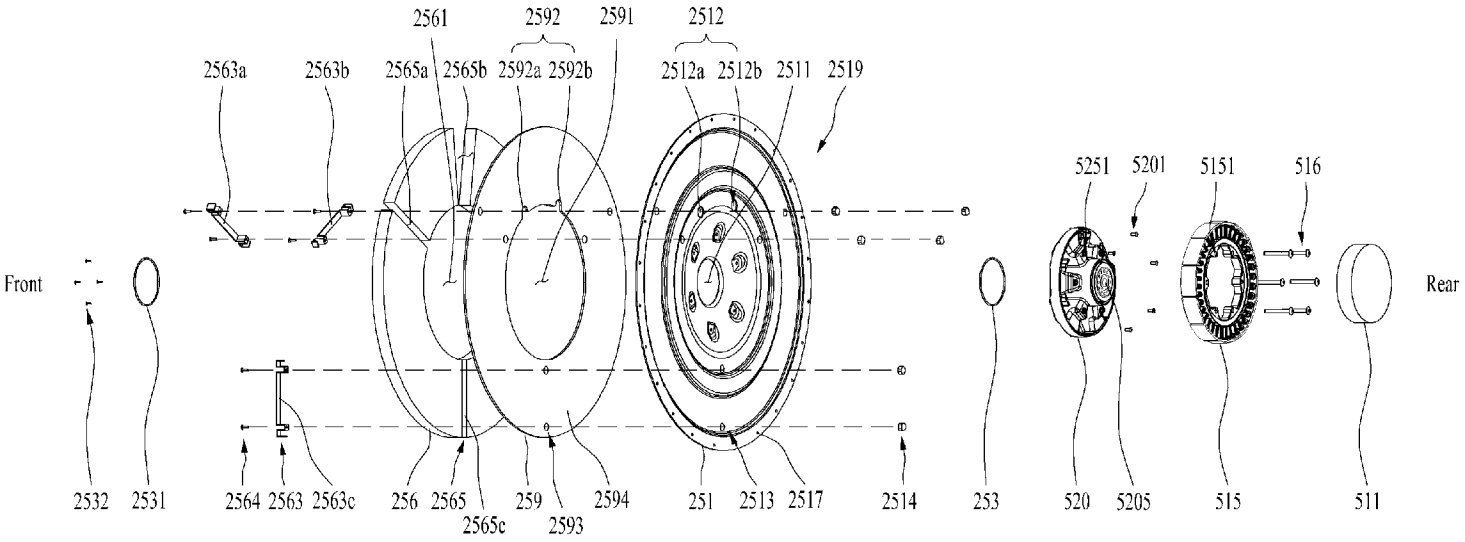
FIG. 10 is an exploded view showing examples of a separator and a driver.

FIG. 10 is an exploded view of the separator 250 and the driver 500. However, the rotation shaft 519 coupled with the drum 300 is omitted in the driver 500.

Referring to FIG. 10, the separator 250 that supports the drum 300 and the driver 500 can include the support plate 251 that is coupled to the first housing 211 to support the separator 250.

The separator 250 can further include the heat exchanger 256 positioned between the drum 300 and the support plate 251 to supply heat to the first chamber 210. In some examples, the separator 250 can further include the heat insulator 259 positioned between the heat exchanger 256 and the support plate 251 to prevent the heat supplied through the heat exchanger 256 from being transferred to the second chamber.

Both the heat exchanger 256 and the heat insulator 259 can be supported by being coupled to the support plate 251, and the heat exchanger 256 and the heat insulator 259 can be located in the first chamber 210. In some examples, the driver 500 can be located on an opposite side of the drum, that is, in the second chamber 220.

The driver 500 can include the motor 510 and the rotation shaft 519 that transmits the rotation force of the motor 510 to the drum 300. The motor 510 can include a stator 515 that forms a rotating magnetic field, and a rotor 511 that rotates based on the rotating magnetic field. The rotation shaft 519 can be connected to the rotor 511 to transmit the rotation force of the motor 510 to the drum 300.

The driver 500 can include the bearing housing assembly 520 positioned between the motor 510 and the support plate 251 and coupled to the motor 510 to support the motor 510 and rotatably support the rotation shaft 519. The bearing housing assembly 520 can include a bearing, a bearing housing, and the like for rotatably supporting the rotation shaft (see FIGS. 11A and 11B).

The motor 510 can be screw-coupled to a motor fixing groove 5251 defined in the bearing housing assembly 520 through one or more motor fixing screws 516. In some examples, the bearing housing assembly 520 can be coupled to the support plate 251 through an assembly fixing screw 5201.

Between the bearing housing assembly 520 and the support plate 251, the driver 500 can further include a housing O-ring 253 and a housing O-ring cover 2531 that protects the housing O-ring 253 disposed at the center of the support plate 251 to seal a gap between the first through-hole 2511 and the bearing housing assembly 520 through which the rotation shaft passes.

A front portion directed in a direction toward the drum of the bearing housing assembly 520 can be slightly inserted into the first through-hole 2511. The housing O-ring 253 can be positioned on a side of the inserted front portion to seal a gap between the support plate 251 and the bearing housing assembly 520.

This is to prevent liquid carbon dioxide from coming into contact with the driver 500 in case of prolonged contact with liquid carbon dioxide accommodated in the first chamber 210 and/or the second chamber 220 although the motor 510 and the rotation shaft 519 are made of a material resistant to liquid carbon dioxide. This is because, although liquid carbon dioxide does not cause an electrical short unlike water, lubricating oil and the like of the motor can dissolve in liquid carbon dioxide.

The housing O-ring 253 can be made of an elastic material such as silicone or rubber, but may not be limited to such material, and can be made of any material as long as it can prevent the flow or the leakage of carbon dioxide.

While the housing O-ring 253 is located on the same side as the driver 500 with respect to the support plate, the ring-shaped housing O-ring cover 2531 for protecting the housing O-ring 253 can be located on the same side as the heat exchanger 256 with respect to the support plate.

The housing O-ring cover 2531 can be coupled to a front of the inserted front portion of the bearing housing assembly 520 through a housing O-ring screw 2532.

The support plate 251 can include the first through-hole 2511 penetrating the center of the support plate 251 to pass the rotation shaft 519 therethrough. In some examples, the support plate 251 can further include at least one second through-hole 2512 spaced apart from the first through-hole 2511 and penetrating the support plate 251. Through said at least one second through-hole 2512, gaseous carbon dioxide of carbon dioxide accommodated in the first chamber 210 and/or the second chamber 220 can flow between the first chamber 210 and the second chamber 220, so that the first chamber 210 and the second chamber 220 can become in the pressure equilibrium.

FIG. 10 shows that the two second through-holes 2512*a* and 2512*b* are defined, but one second through-hole or three or more second through-holes can be defined when the flow of gaseous carbon dioxide is possible for the pressure equilibrium.

In some implementations. because it can be advantageous and faster for gaseous carbon dioxide to flow than for a relatively large amount of liquid carbon dioxide for the pressure equilibrium, gaseous carbon dioxide rather than liquid can flow through the at least one second through-hole 2512.

For example, when the support plate 251 is coupled to the first housing 211, a vertical level of a center of said at least one second through-hole 2512 from the cabinet bottom part can be higher than a vertical level of a center of the first through-hole 2511.

In some examples, because a maximum level of liquid carbon dioxide accommodated in the first chamber 210 and/or the second chamber 220 with respect to the cabinet bottom part is lower than a minimum vertical level of said at least one second through-hole 2512, it can be possible to prevent liquid carbon dioxide from flowing through said at least one second through-hole 2512. That is, the level of liquid carbon dioxide accommodated in the first chamber 210 and/or the second chamber 220 with respect to the cabinet bottom part will always be lower than the vertical level of the center of the at least one second through-hole 2512 minus a radius of the at least one second through-hole 2512.

In one example, the second through-hole 2512 can also serve as a passage through which the first refrigerant pipe 2567 (see FIG. 8) and the second refrigerant pipe 2568 pass.

In some examples, the support plate 251 can include a plurality of fourth through-holes 2517 penetrating the support plate 251 at positions corresponding to the support plate coupling portion 2121 in order to couple the support plate 251 to the first flange 212. The support plate can be screwed to the support plate coupling portion 2121 using the plurality of fourth through-holes 2517.

The heat exchanger 256 can include the first refrigerant pipe 2567 that supplies the refrigerant to the heat exchanger 256, the second refrigerant pipe 2568 that discharges the refrigerant that has circulated through the heat exchanger 256, and a connection refrigerant pipe 2569 that connects the first refrigerant pipe 2567 and the second refrigerant pipe 2568 to each other to supply heat to carbon dioxide accommodated in the first chamber 210.

A high-temperature refrigerant is supplied through the first refrigerant pipe 2567. After exchanging heat with the carbon dioxide through the connection refrigerant pipe 2569, the cooled refrigerant will be discharged through the second refrigerant pipe 2568. The connection refrigerant pipe 2569 forms a body of the heat exchanger. As shown in FIG. 10, the connection refrigerant pipe 2569 can be connected in a form of meandering along an outer shape of the heat exchanger 256. This is to widen a contact area with carbon dioxide accommodated in the first chamber 210 as much as possible.

Supplying the heat through the heat exchanger 256 can help to prevent a situation in which the temperature drops sharply and the laundry is hardened or damaged when discharging liquid carbon dioxide from the first chamber 210 and/or the second chamber 220, or discharging gaseous carbon dioxide.

In some examples, the heat exchanger 256 can include a central cavity 2561 defined therein through which the rotation shaft 519 is inserted and passes corresponding to a size of the first through-hole 2511. The heat exchanger can have a donut shape. In some examples, the size of the central cavity 2561 can be greater than or equal to the size of the first through-hole 2511.

The heat exchanger 256 can supply the heat as the refrigerant circulates, but otherwise, an electric heater can be used.

The heat exchanger 256 can be coupled to one of both sides of the support plate 251 facing the drum 300. For example, at least one cutout 2565 in which the connection refrigerant pipe 2569 is not filled in the radial direction around the central cavity 2561 to make the donut shape of the heat exchanger 256 to appear to have a cut portion can be included.

The at least one cutout 2565 is not completely cut and the heat exchanger is not separated into several portions, and the portions are able to be connected to each other by at least one connection refrigerant pipe 2569. The connection refrigerant pipe 2569 can include a plurality of fins extending in a radial direction of the connection pipe at regular spacings. This is to further expand a heat exchange area.

The heat insulator 259 can include a heat insulator body 2594 made of a thermal insulation material to form a body of the heat insulator 259, a first heat insulator hole 2591 corresponding to the first through-hole and penetrating a center of the insulator body, and at least one second heat insulator hole 2592 that passes through the heat insulator body corresponding to the number and a size of at least one second through-hole 2512.

The at least one second heat insulator hole 2592 can be defined to be spaced apart from the first heat insulator hole 2591. When the support plate 251 and the heat insulator 259 are coupled to each other, at least one third through-hole 2513 and the at least one second heat insulator hole 2592 can communicate with each other. In some examples, when the heat insulator 259 is coupled to the heat exchanger 256, the cutout 2565 can correspond to and communicate with the at least one second through-hole 2512 and the at least one second heat insulator hole 2592.

The second heat insulator hole 2592 can be attached to and connected to the first heat insulator hole 2591. FIG. 10 shows the second heat insulator hole 2592 defined by partially recessing the first heat insulator hole 2591 in the radial direction of the heat insulator body.

In one example, the heat insulator 259 can further include at least one connection screw through-hole 2593 for the coupling with the heat exchanger 256 and the support plate 251. FIG. 10 illustrates a state in which each connection screw through-hole 2593 is defined at a position corresponding to each cutout 2565. Likewise, the support plate 251 can further include at least one third through-hole 2513 defined at a position corresponding to the connection screw through-hole 2593.

Therefore, when a bracket 2563 for coupling the heat exchanger 256, the heat insulator 259, and the support plate 251 to each other is located in the cutout 2565, after a connection screw 2564 passes through a screw hole of the bracket 2563, the at least one third through-hole 2513, and the at least one second heat insulator hole 2592, the connection screw 2564 can be coupled to a cap nut 2514 located inside the second chamber.

In some cases, a general nut can be used instead of the cap nut 2514. In some examples, the cap nut 2514 can be used to help to prevent liquid carbon dioxide from penetrating a screw thread.

Figure 11B:
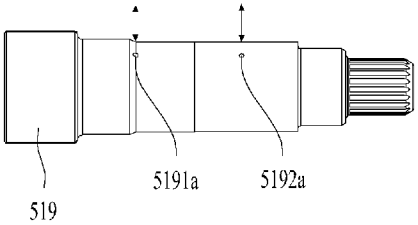
FIG. 11B shows an example portion of the rotation shaft.
Figure 11A:
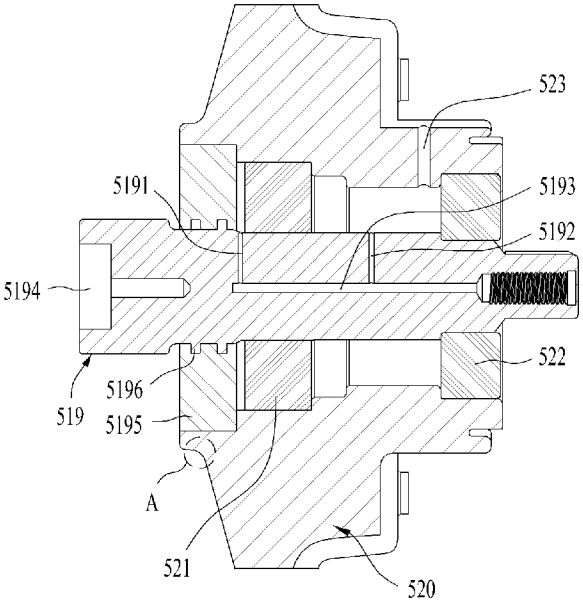
FIG. 11A is an enlarged view showing example portions of a rotation shaft and a bearing housing.

FIGS. 11A and 11B are enlarged views of portions of the rotation shaft 519 and the bearing housing assembly 520. The rotation shaft 519 can be rotatably supported by the bearing housing assembly 520.

Referring to FIG. 11A, the rotation shaft 519 can include a drum coupling portion 5194 connected to the rotation support 330 disposed on the drum rear part 303. A diameter of the drum coupling portion 5194 can be larger than a diameter of a portion of the rotation shaft 519 that is inserted into and passes through the first through-hole 2511 and the first heat insulator hole.

The bearing housing assembly 520 can include a housing through-hole 5205 (see FIG. 10) passing through the bearing housing assembly 520 in a longitudinal direction of the rotation shaft to allow the rotation shaft 519 to pass therethrough. In some examples, the bearing housing assembly 520 can include a first bearing 521 and a second bearing 522 inserted into the housing through-hole 5205 to rotatably support the rotation shaft 519. This is to support the rotation shaft to shake less than when using a single bearing.

The bearing housing assembly 520 can include a shaft O-ring 5196 and a shaft sealing cover 5195 for helping to prevent leakage of liquid carbon dioxide through the rotation shaft 519 and the bearing housing assembly 520. This is to protect the first bearing 521 and the second bearing 522 and to protect the motor 510. At least one shaft O-ring 5196 can be disposed.

The shaft sealing cover 5195 can help to prevent deviation of the shaft O-ring 5196. This is because the shaft O-ring 5196 can deviate by a suction pressure of the transferring member 490 when the carbon dioxide used in the first chamber 210 flows to the second chamber 220 using the transferring member 490. In order to prevent this, the shaft O-ring 5196 can be formed in a shape of being surrounded by the shaft sealing cover 5195 such that the shaft O-ring 5196 is protected by the shaft sealing cover. That is, the shaft sealing cover 5195 can also be formed in a ring shape and inserted into the housing through-hole 5205, and can be positioned between the drum coupling portion 5194 and the first bearing 521.

As described above, the driver 500 can further include the housing O-ring 253 and the housing O-ring cover 2531 for protecting the housing O-ring 253 to seal the gap between the bearing housing assembly 520 and the first through-hole 2511 through which the rotation shaft 519 passes. In some implementations, the housing O-ring 253 can be disposed to be in contact with the bearing housing assembly 520 at a portion A. When the bearing housing assembly 520 is coupled to the support plate 251, the housing O-ring 253 can come into close contact with and be disposed between the bearing housing assembly 520 and the support plate 251 to help to prevent the leakage of carbon dioxide.

In some examples, the housing O-ring cover 2531 can be coupled to a front side of the bearing housing assembly 520 facing the drum. Accordingly, the housing O-ring cover 2531 can be positioned between the drum coupling portion 5194 and the shaft sealing cover 5195 to be coupled to the bearing housing assembly 520.

In one example, even after the rotation shaft 519, the first bearing 521, the second bearing 522, the shaft O-ring 5196, and the shaft sealing cover 5195 are positioned in the housing through-hole 5205, empty spaces can exist in the housing through-hole 5205. When pressures of such empty spaces are different from the pressure of the pressure vessel, lifespans of the rotation shaft 519, the first bearing 521, the second bearing 522, the shaft O-ring 5196, and the shaft sealing cover 5195 can be reduced. This is because a stress caused by the pressure difference occurs. In order to reduce or prevent such stress, the pressures of the empty spaces can be maintained to be the same as the pressure of the first chamber and/or the second chamber.

For example, the bearing housing assembly 520 can further include a shaft communication hole 523 defined therethrough at a location between the first bearing 521 and the second bearing 522 such that the second chamber 220 and the housing through-hole 5205 communicate with each other. In some examples, a first flow path 5191 located between the shaft sealing cover 5195 and the first bearing 521 and defined by drilling the rotation shaft 519 in the radial direction from a center of the rotation shaft 519, a second flow path 5192 located between the first bearing 521 and the second bearing 522 and defined by drilling the rotation shaft 519 in the radial direction from the center of the rotation shaft 519, and a connection flow path 5193 that connects the first flow path 5191 and the second flow path 5192 to each other can be included.

Gaseous carbon dioxide accommodated in the second chamber 220 can flow into/out of the housing through-hole 5205 through the shaft communication hole 523, and can flow into/out of the empty space of the housing through-hole 5205 again through the second flow path 5192, the connection flow path 5193, and the first flow path 5191. Therefore, it is possible to achieve the pressure equilibrium and prevent the stress occurring on the rotation shaft 519, the first bearing 521, the second bearing 522, the shaft O-ring 5196, and the shaft sealing cover 5195 by the pressure difference.

FIG. 11B shows a first opening 5191*a* and a second opening 5192*a* defined by the first flow path 5191 and the second flow path 5192, respectively. Arrows indicate that gaseous carbon dioxide can flow into/out of the housing through-hole 5205 through the first opening 5191*a* and the second opening 5192*a* to reach the pressure equilibrium.

Figure 12B:
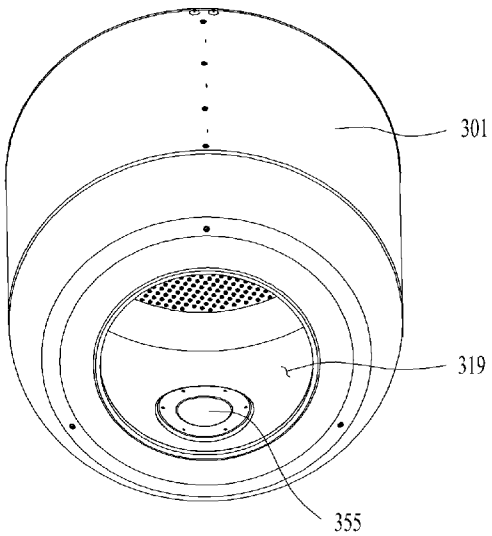
FIG. 12B shows examples of a filter hole and a filter access cover that is disposed on a side of a drum body.
Figure 12A:
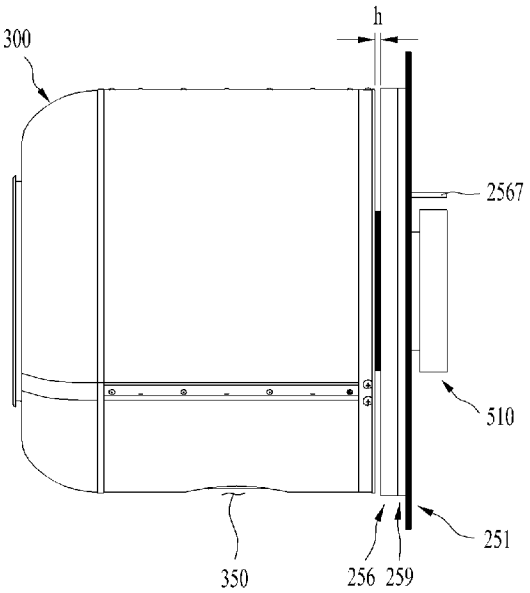
FIG. 12A shows examples of a drum and a separator that are assembled with each other and viewed from a side.

FIG. 12A shows a state in which the drum 300 and the separator 250 are assembled with each other viewed from a side. In some examples, the cylindrical drum body 301 forming the body of the drum 300 can include the plurality of side through-holes 320 penetrating the side of the drum body 301 (see FIG. 5). In some examples, as shown in FIGS. 12A and 12B, the plurality of side through-holes 320 can be omitted to facilitate description of other components.

Referring to FIG. 12A, the drum body 301 and the separator 250 are spaced apart from each other by a predetermined spaced distance h. This is to prevent the drum rear part 303 and the separator 250 from interfering with each other when the drum body 301 rotates.

Figures 13A, 13B:
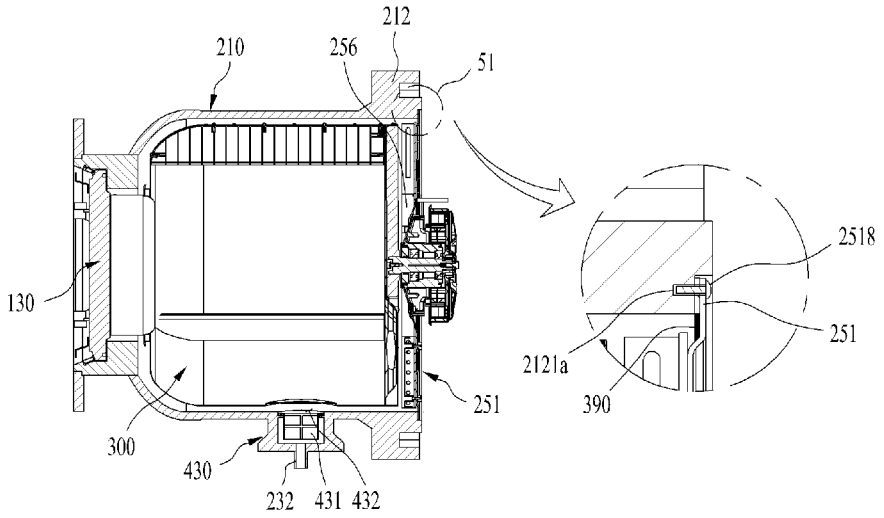
FIG. 13A shows a cross-section of an example of a first chamber.
FIG. 13B is an enlarged view of S1 indicated by a dotted line in FIG. 13A.

Referring to FIGS. 12A and 12B, the drum body 301 can include a filter hole 350 and a filter access cover 355 disposed on the side of the drum body 301 to be accessible to a filtration assembly 430 (see FIGS. 13A and 13B). This is to replace a filter 431 (see FIGS. 13A and 13B) disposed in the filtration assembly 430 or to remove the contaminants filtered by the filter 431. When the filter access cover 355 is opened through the drum inlet 319, it is possible to easily access the filtration assembly 430.

FIG. 13A is a cross-sectional view showing a state in which the drum 300, the separator 250, and the first housing 211 are assembled to each other. Referring to FIG. 13A, when the door 130 is closed, the chamber inlet 219 is also closed to be in a state capable of supplying high-pressure carbon dioxide to the pressure vessel 200.

The filtration assembly 430 can be disposed at the second connector 232 disposed to connect the first chamber 210 with the transferring member 490, the first chamber 210 with the second chamber 220, and/or the first chamber 210 with the exhaust portion 480. FIG. 13B shows an example in which the filtration assembly 430 is disposed between the first housing and the filtration assembly 430. That is, the filtration assembly 430 can include a filter insertion hole 432 passing through a side of the first housing 211, and the filter 431 inserted through the filter insertion hole. In some examples, the filtration assembly 430 can be connected to the first connector 231.

FIG. 13B is an enlarged view of S1 indicated by a dotted line in FIG. 13A. The region S1 is a position where the first flange 212 and the support plate 251 are coupled to each other. As described above, the support plate 251 can include a plurality of fourth through-holes 2517 passing through the support plate 251 at positions corresponding to the support plate coupling portion 2121 to couple the support plate 251 to the first flange 212.

The support plate coupling portion 2121 can include a plurality of support plate coupling grooves 2121*a* corresponding to the plurality of fourth through-holes 2517. After aligning each of the plurality of fourth through-holes 2517 and each of the plurality of support plate coupling grooves 2121*a* having a screw thread therein to communicate with each other, each of the plurality of fourth through-holes 2517 and each of the plurality of support plate coupling grooves 2121*a* can be screwed together with a separator fastening screw 2518.

Referring to FIG. 13B, the support plate coupling portion 2121 can be defined by recessing a portion of the first flange 212 corresponding to an outer diameter of the support plate 251 by a depth equal to or greater than a thickness of the support plate 251 and a head size of the separator fastening screw 2518. Therefore, a stepped structure can be formed between a portion of the first flange 212 in which the support plate coupling portion 2121 is not defined and the portion of the first flange 212 in which the support plate coupling portion 2121 is defined. This is to avoid interference with the support plate 251 when the first flange 212 and the second flange 222 are coupled to each other.

Figure 14B:
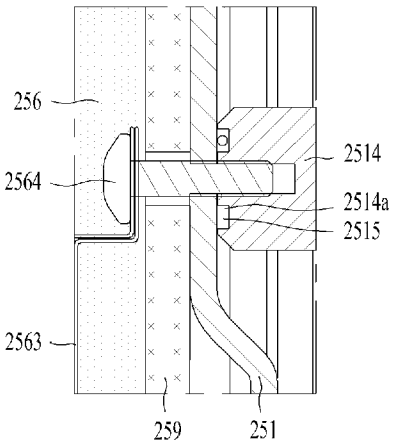
FIG. 14B is an enlarged view of a cross-section taken along a line A-A' in FIG. 14A.
Figure 14A:
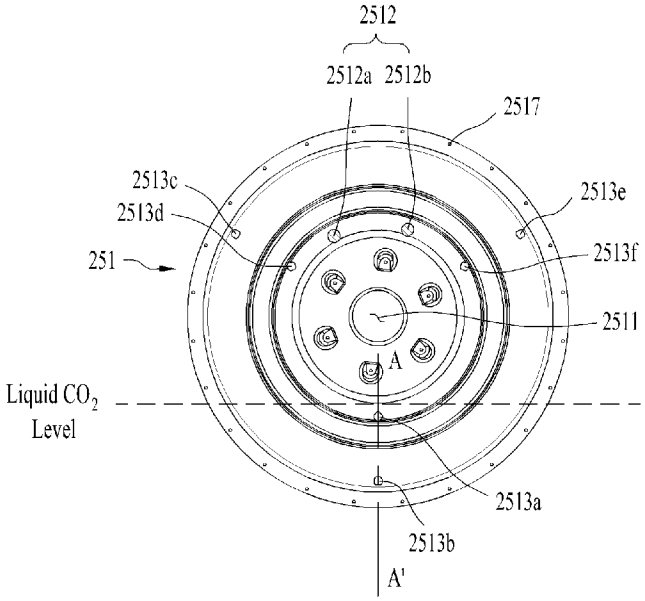
FIG. 14A shows one side of an example of a support plate.

FIG. 14A shows one side of the support plate 251 viewed in a direction of the second chamber 220. The support plate 251 can include the first through-hole 2511 penetrating the center of the support plate 251 to allow the rotation shaft 519 to pass therethrough. In some examples, the support plate 251 can further include the at least one second through-hole 2512 spaced apart from the first through-hole 2511 and penetrating the support plate 251. Through the at least one second through-hole 2512, gaseous carbon dioxide of carbon dioxide accommodated in the first chamber 210 and/or the second chamber 220 flows between the first chamber 210 and the second chamber 220, so that the first chamber 210 and the second chamber 220 can achieve the pressure equilibrium.

FIGS. 14A and 14B show that the two second through-holes 2512*a* and 2512*b* are defined, but one second through-hole or three or more second through-holes can be defined when flow of gaseous carbon dioxide is possible for the pressure equilibrium.

In some implementations, because it can be advantageous and faster for gaseous carbon dioxide to flow than for the relatively large amount of liquid carbon dioxide for the pressure equilibrium between the first chamber 210 and the second chamber 220, gaseous carbon dioxide rather than liquid carbon dioxide can flow through the at least one second through-hole 2512.

For example, when the support plate 251 is coupled to the first housing 211, the vertical level of the center of the at least one second through-hole 2512 from the cabinet bottom part can be higher than the vertical level of the center of the first through-hole 2511.

In some examples, because the maximum level of liquid carbon dioxide accommodated in the first chamber 210 and/or the second chamber 220 with respect to the cabinet bottom part is lower than the minimum vertical level of the at least one second through-hole 2512, it is possible to prevent liquid carbon dioxide from flowing through the at least one second through-hole 2512. That is, the level of liquid carbon dioxide accommodated in the first chamber 210 and/or the second chamber 220 with respect to the cabinet bottom part will always be lower than the vertical level of the center of the at least one second through-hole 2512 minus the radius of the at least one second through-hole 2512.

In one example, the second through-hole 2512 can also serve as the passage through which the first refrigerant pipe 2567 (see FIG. 8) and the second refrigerant pipe 2568 pass.

The support plate 251 can include the second through-hole 2512 defined to be spaced apart from the center of the support plate 251 by the predetermined distance. This is to pass the first refrigerant pipe 2567 and the second refrigerant pipe 2568 for circulating the refrigerant to the heat exchanger to be described later. FIG. 8 shows that the two second through-holes 2512*a* and 2512*b* are defined and the first refrigerant pipe 2567 and the second refrigerant pipe 2568 pass through the second through-holes 2512*a* and 2512*b*, respectively. However, this is only an example. In one example, after one second through-hole 2512 is defined, both the first refrigerant pipe 2567 and the second refrigerant pipe 2568 can pass through one second through-hole 2512. In some examples, two or more second through-holes 2512 can be defined.

In some examples, the second through-hole 2512 provides the passage through which gaseous carbon dioxide can flow in the both directions for the pressure equilibrium between the first chamber 210 and the second chamber 220. As described above, in order for liquid carbon dioxide to exist at the room temperature, the high pressure can be provided, where the pressure vessel 200 is designed to withstand the high pressure higher than the atmospheric pressure, for example, 50 bar. Therefore, the support plate 251 present in the pressure vessel 200 must also have the sufficient thickness to withstand the high pressure.

In some cases, because the support plate 251 can be deformed by the pressure difference between the first chamber 210 and the second chamber 220, the pressures of the both chambers can be maintained in the equilibrium state using the second through-hole 2512 for the pressure equilibrium of the both chambers as gaseous carbon dioxide flows through the second through-hole 2512.

In some examples, the support plate 251 can further include the at least one third through-hole 2513 through which the connection screw 2564 for coupling the heat exchanger 256 and the heat insulator 259 to each other passes.

In some examples, the support plate 251 can include the plurality of fourth through-holes 2517 penetrating the support plate 251 at the positions corresponding to the support plate coupling portion 2121 in order to couple the support plate 251 to the first flange 212. The support plate can be screwed to the support plate coupling portion 2121 using the plurality of fourth through-holes 2517.

The plurality of fourth through-holes 2517 can be aligned along a circumferential direction adjacent to an outer portion of the support plate.

FIG. 14B is an enlarged view of a cross-section taken along a line A-A'. Referring to FIG. 14B, the connection screw 2564 is inserted into a screw hole of the bracket 2563, the third through-hole 2513, and the connection screw through-hole 2593 and coupled to the cap nut 2514, and thus, the heat exchanger 256 and the heat insulator 259 are coupled to the support plate 251.

In some cases, although the connection screw 2564 and the cap nut 2514 are coupled to each other, carbon dioxide may leak into the second chamber 220 by the screw hole of the bracket 2563, the third through-hole 2513, and the connection screw through-hole 2593. To help prevent this, in some implementations, the cap nut 2514 can include a cap nut O-ring insertion hole 2514*a* defined by being recessed along a circumferential direction of the cap nut at a portion in contact with the support plate 251. In some examples, a cap nut O-ring 2515 can be inserted into the cap nut O-ring insertion hole 2514*a*. Therefore, when the cap nut 2514 and the connection screw 2564 are coupled to each other, the cap nut O-ring 2515 can be disposed between and be in close contact with the cap nut 2514 and the support plate 251 to prevent the leakage of carbon dioxide.

The cap nut O-ring 2515 can be made of a Teflon-based material such as polytetrafluoroethylene (PTFE) having excellent corrosion resistance. However, the present disclosure is not limited thereto.

Figure 15C:
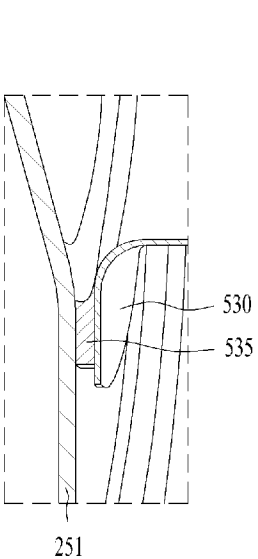
FIG. 15C is an enlarged view of a portion indicated by S2 in FIG. 15B.
Figure 15B:
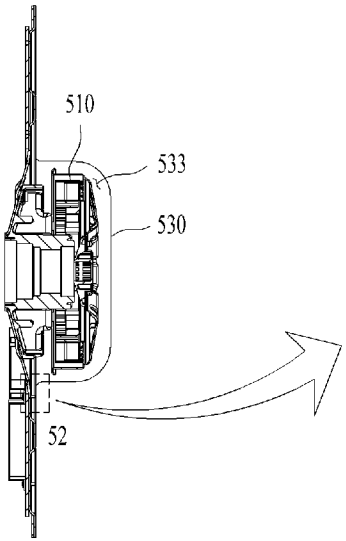
FIG. 15B shows a cross-section taken along a line B-B' in FIG. 15A.
Figure 15A:
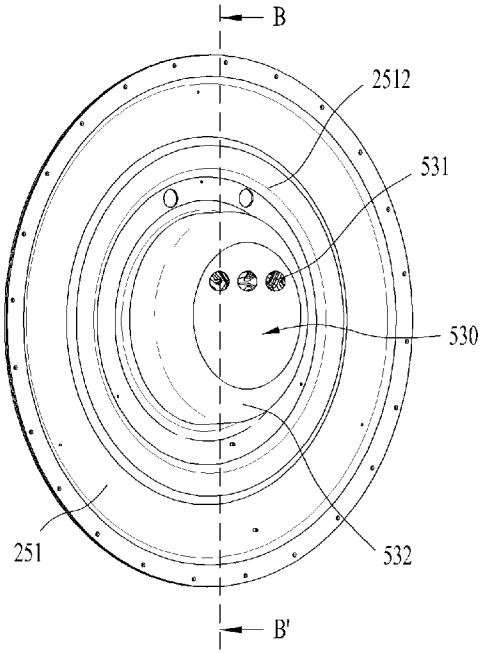
FIG. 15A shows examples of a support plate and a motor protection cover.

FIG. 15A shows the support plate 251 and a motor protection cover 530. The driver 500 can further include the motor protection cover 530 that covers the motor and the bearing housing assembly and is coupled to the support plate to prevent the motor 510 and the bearing housing assembly 520 from contacting liquid carbon dioxide.

The motor protection cover 530 can include a protection body 532 that is recessed to define therein a recessed space 533 in which the motor 510 and the bearing housing assembly 520 are accommodated, and at least one cover communication hole 531 defined to pass through the protection body 532 along the rotation shaft direction.

An outer diameter of the motor protection cover 530 can be greater than a diameter of the first through-hole 2511. In some examples, an inner diameter of the motor protection cover 530 can be greater than an outer diameter of the bearing housing assembly 520 and an outer diameter of the motor 510. In some examples, a recessed depth of the protection body can be greater than a length along the rotation shaft direction of an assembly in which the bearing housing assembly 520 and the motor 510 are coupled to each other. Accordingly, when the motor protection cover 530 is coupled to the support plate 251, both the bearing housing assembly 520 and the motor 510 can be accommodated in the recessed space.

The motor protection cover 530 can include at least one cover communication hole 531 penetrating the motor protection cover 530 in a direction parallel to the rotation shaft 519.

As described above, in order to prevent the stress occurring on the rotation shaft 519, the first bearing 521, the second bearing 522, the shaft O-ring 5196, and the shaft sealing cover 5195 resulted from the pressure difference, the rotation shaft 519 can induce the pressure equilibrium with the free inflow/outflow of gaseous carbon dioxide through the second flow path 5192, the connection flow path 5193, and the first flow path 5191 defined in the rotation shaft 519. For example, the motor protection cover 530 can also include the at least one cover communication hole 531 to ensure the free inflow/outflow of gaseous carbon dioxide.

In some examples, a vertical level of the at least one cover communication hole 531 is higher than the level of the liquid carbon dioxide stored in the second chamber.

FIG. 15B shows a cross-section taken along a line B-B' in FIG. 15A. The motor protection cover 530 can define the recessed space 533 in which the bearing housing assembly 520 and the motor 510 are accommodated. Referring to FIG. 15B, although the motor 510 is shown to rotate the drum 300, another driver can be disposed when it is possible to rotate the rotation shaft 519. For example, a magnetic gear apparatus can be used instead of the motor 510.

FIG. 15C is an enlarged view of a portion indicated by S2 in FIG. 15B.

As described above, through the cover communication hole 531, gaseous carbon dioxide can freely flow into/out of the motor protection cover 530, that is, the recessed space 533. In some examples, liquid carbon dioxide can be prevented from coming into contact with the motor 510 and the bearing housing assembly 520. This is because, although liquid carbon dioxide does not cause the electrical short unlike water, lubricating oil and the like of the motor can dissolve in liquid carbon dioxide. In some examples, even when the motor 510 and the rotation shaft 519 are made of a material resistant to liquid carbon dioxide, they can minimize contact with the liquid carbon dioxide accommodated in the chamber and/or the second chamber 220 for a long time. For example, the driver 500 can further include a motor cover sealing portion 535 between the support plate 251 and the motor protection cover 530. The motor cover sealing portion 535 can be a gasket made of a material such as graphite.

The motor cover sealing portion 535 can be formed in a ring shape to correspond to a portion coupled to the support plate 251 of the protection body 532 except for a portion defining the recessed space 533.

Figure 16:
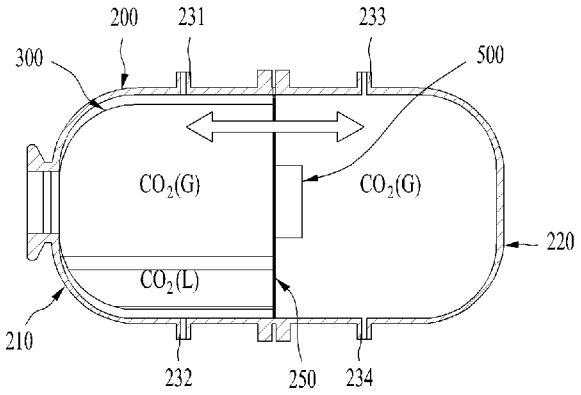
FIG. 16 shows an example of a pressure equilibrium established between an interior of a first housing and an interior of a second housing through a second through-hole.

FIG. 16 schematically shows the pressure vessel 200. The pressure vessel 200 can be separated into the first chamber 210 and the second chamber 220 by the separator 250. The drum 300 can be located inside the first chamber 210, and the contaminants attached to the laundry accommodated in the drum 300 can be removed using liquid carbon dioxide of carbon dioxide supplied through the supplying member 410.

In some examples, gaseous carbon dioxide can flow through the second through-hole 2512 in the first chamber 210, so that the first chamber 210 and the second chamber 220 can achieve the pressure equilibrium. As described above, the housing through-hole 5205 can also achieve the pressure equilibrium through the cover communication hole 531, the shaft through-hole, the second flow path 5192, the connection flow path 5193, and the first flow path 5191.

Even when liquid carbon dioxide discharged from the first chamber 210 is stored in the second chamber 220, the pressure equilibrium will be achieved as well. In some examples, even when carbon dioxide is discharged to the outside through the exhaust portion from the first chamber 210, the first chamber 210 and the second chamber 220 will achieve the pressure equilibrium.

Figure 17:
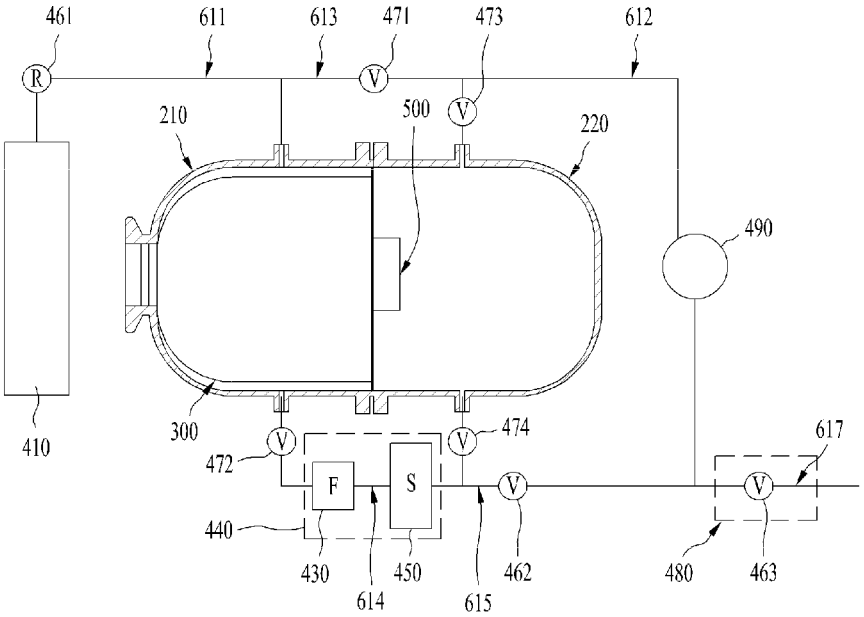
FIG. 17 schematically shows an example of a connection relationship between major components of the laundry treating apparatus.

FIG. 17 schematically shows an example of pipe connection states between major components and locations of valves of the laundry treating apparatus 1000 described in the present disclosure. In particular, various modifications are possible in the pipe connection states between the major components. When looking at the pipe as a line and each major component as a point, when a topology of the lines connecting the points to each other is the same, it can be determined to be the same as the example described with reference to FIG. 17.

In some examples, the valves can be located anywhere as long as the valves can open and close the pipes respectively responsible for.

Referring to FIG. 17, the supplying member 410 and the first chamber 210 can be connected to each other by a pipe, so that the supplying member 410 can supply carbon dioxide to the first chamber 210. In some examples, carbon dioxide can be supplied as gaseous carbon dioxide or as liquid carbon dioxide. The supplying member 410 can include the flow rate regulator 461. The flow rate regulator 461, for example, a regulator, is an apparatus capable of supplying the fluid while maintaining a constant pressure. The flow rate regulator 461 can have a function of opening and closing the pipe and a function of measuring the pressure and maintaining the pressure constant at the same time.

Therefore, carbon dioxide can be supplied until the pressure of the first chamber 210 reaches equilibrium with the pressure of the supplying member 410.

However, alternatively, carbon dioxide can be supplied until the pressure of the first chamber 210 reaches a preset chamber pressure.

The first chamber 210 and the second chamber 220 can be connected to each other as the first connector 231 and the first protruding end 233 are connected to each other by a pipe. It is shown in FIG. 17 that a first supply pipe 611 that connects the supplying member 410 and the first connector 231 to each other, and a supply connection pipe 613 to which the first connector 231 and the first protruding end 233 are connected are combined into one in the middle, but this is only an example. The first supply pipe 611 and the supply connection pipe 613 can be independently connected to the first connector 231.

A connection valve 471 can be disposed on the supply connection pipe 613 to open and close the supply connection pipe 613. The supply connection pipe 613 and the first supply pipe 611 can be combined with each other, and the connection valve 471 can be located on the supply connection pipe 613 upstream of the first supply pipe 611.

The second connector 232 and the first protruding end 233 can be connected to each other to transfer liquid carbon dioxide discharged from the first chamber 210 to the second chamber 220 using the transferring member 490. For example, a pipe that connects the second connector 232 and the transferring member 490 to each other can be referred to as a first discharge pipe 614. In some examples, a pipe that connects the transferring member 490 and the second chamber 220 to each other can be referred to as a second supply pipe 612.

The transferring member 490 can be used when transferring liquid carbon dioxide discharged from the first chamber 210 to the second chamber 220 or transferring liquid carbon dioxide stored in the second chamber 220 to the first chamber 210. For example, the transferring member 490 can be constructed as a pump or a compressor. In other words, as long as it is able to transfer liquid carbon dioxide, other fluidic machinery can be used.

In one example, oil for lubrication of the transferring member 490 can be dissolved in liquid carbon dioxide passing through the transferring member 490 and flow together with liquid carbon dioxide. An oil separator can filter the oil. For instance, an oil separator 450 included in the purifier 440 to be described later can be used, or a separate and independent oil separator can be disposed.

A first discharge valve 472 can be positioned on the first discharge pipe 614. In some examples, the contaminants discharged from the laundry will also be discharged along with the liquid carbon dioxide used in and discharged from the first chamber 210. Accordingly, the laundry treating apparatus 1000 can further include the purifier 440 for removing the contaminants from the liquid carbon dioxide when the transferring member 490 transfers the liquid carbon dioxide of the first chamber to the second chamber 220.

The purifier 440 can include the filtration assembly 430 and the oil separator 450 to filter the contaminants.

When the laundry is washed, liquid carbon dioxide will contain the contaminants removed from the laundry. The contaminants can contain the foreign substances attached to the laundry and the lipophilic substances attached to the laundry.

The foreign substances can exist in a state of being mixed and suspended in liquid carbon dioxide. For example, the foreign substances can include substances of various sizes, shapes, or types such as lint, dust, fine dust, hair, animal hair, skin keratin, bacteria, viruses, soot particles, odor particles, and/or heavy metals.

In some examples, the contaminants can be in a state of being dissolved in liquid carbon dioxide. The contaminants can contain the lipophilic substances such as organic solvents.

In some examples, the contaminants can contain the water-soluble substance adsorbed to the laundry. Because the water-soluble substance is hydrophilic and liquid carbon dioxide is hydrophobic, the water-soluble substance may not dissolve well in the liquid carbon dioxide. A detergent or a surfactant for dissolving the water-soluble substance can be used.

Accordingly, the purifier 440 can include the filtration assembly 430 that filters the foreign substances mixed in liquid carbon dioxide of carbon dioxide supplied to the first chamber 210, and the oil separator 450 that separates the lipophilic substances dissolved in liquid carbon dioxide.

Because the purifier 440 also needs to purify liquid carbon dioxide discharged from the first chamber 210, the purifier 440 will be located on the first discharge pipe. Although it is shown in FIG. 17 that liquid carbon dioxide discharged from the first chamber 210 passes through the filtration assembly 430 after passing through the first discharge valve 472, but this is only an example. As shown in FIGS. 13A and 13B, the filtration assembly 430 can be disposed in a state coupled to the first chamber 210, and liquid carbon dioxide discharged from the first chamber can first pass through the filtration assembly 430 and then pass through the first discharge valve 472. This is also applied to the position of the oil separator 450 is the same manner as that of the filtration assembly 430.

Using the transferring member 490 to supply liquid carbon dioxide of carbon dioxide stored in the second chamber to the first chamber, carbon dioxide can be discharged from the second chamber 220 and supplied to the first chamber 210 through the transferring member 490. For example, liquid carbon dioxide can flow through the supply connection pipe 613, which is a pipe that connects the transferring member 490 and the first chamber to each other, for connecting a second discharge pipe, which is a pipe that connects the second protruding end 234 and the transferring member 490 to each other, and the transferring member 490 to the first chamber.

It is shown in FIG. 17 that the first discharge pipe 614 is combined with the second discharge pipe 615 and connected to the transferring member, and the supply connection pipe 613 is branched from the second supply pipe 612 came out of the transferring member and combined with the first supply pipe 611. However, this is only an example. Therefore, as described above, the first discharge pipe 614 and the second discharge pipe can be independently connected to the transferring member 490, and the supply connection pipe 613 and the second supply pipe 612 came out of the transferring member 490 can be connected to the first chamber 210 and the second chamber 220, respectively. This is because the flow can be controlled by opening and closing appropriate valves.

In a description with reference to FIG. 17, before the first discharge pipe 614 is combined with the second discharge pipe 615, liquid carbon dioxide discharged from the first chamber 210 can flow into the second discharge pipe 615 through the first discharge valve 472, the filtration assembly 430, and the oil separator 450 to be introduced into the transferring member 490.

For example, referring to FIG. 17, the second discharge pipe 615 can be combined with the first discharge pipe 614, and a second discharge valve 474 can be included on the second discharge pipe upstream of the first discharge pipe 614. This is to control the flow of liquid carbon dioxide discharged from the second chamber.

In some examples, the first discharge pipe 614 and the second discharge pipe 615 can be combined with each other, and then, connected to the transferring member 490, and a circulation valve can be included upstream of the transferring member 490. The circulation valve 462 can control the flow to the transferring member 490.

Similarly, referring to FIG. 17, it is shown that the supply connection pipe 613 is branched from the second supply pipe 612 came out of the transferring member and combined with the first supply pipe 611. In some examples, the connection valve 471 can be positioned on the supply connection pipe 613 to control the flow of liquid carbon dioxide from the transferring member 490 to the first chamber 210. The second supply pipe 612 can be branched from the supply connection pipe, and a supplying valve 473 can be positioned on the second supply pipe 612 downstream of the supply connection pipe. Therefore, the flow of liquid carbon dioxide from the transferring member 490 to the second chamber 220 can be controlled.

The second discharge pipe 615 can be connected to the exhaust portion 480 after being combined with the first discharge pipe. In some examples, a pipe discharged from the exhaust portion 480 to the outside will be referred to as an external exhaust pipe 617. The exhaust portion 480 can include the exhaust valve 463 to open and close the external exhaust pipe 617. The exhaust portion 480 can also include one or more pipes.

FIG. 17 shows that the first discharge pipe 614 and the second discharge pipe 615 are combined with each other and then pass through the circulation valve 462, and the external exhaust pipe 617 is branched from the second discharge pipe 615 at a position downstream of the circulation valve 462. However, unlike this, the external exhaust pipe 617 can be branched from the second discharge pipe 615 at a position upstream of the circulation valve 462 depending on the control of the valve.

The controller 600 can control the rotation of the drum 300, the operation of the transferring member 490, and the circulation of the refrigerant for the heat exchanger 256. In some examples, the controller 600 can adjust the pressure of carbon dioxide supplied through the flow rate regulator 461 and control whether to supply the carbon dioxide through the opening and the closing of the flow rate regulator 461. In some examples, the controller 600 can open and close the circulation valve 462, the exhaust valve 463, the connection valve 471, the first discharge valve, and the second discharge valve 474.

FIGS. 18 to 22 show a flow direction of carbon dioxide for each operation of a washing cycle of washing laundry using the laundry treating apparatus 1000.

The washing cycle can include a series of cycles or courses performed by the laundry treating apparatus when the user selects a course for washing the laundry. The washing cycle includes a washing operation S200 (see FIG. 23), a first rinsing operation S500 (see FIG. 23), and an exhaust operation S900 (see FIG. 23).

In some examples, the washing cycle can include a first supply operation S100 (see FIG. 23) prior to the washing operation. In some examples, a first purification operation S300 (see FIG. 23) and a second supply operation S400 (see FIG. 23) can be included between the washing operation S200 (see FIG. 23) and the first rinsing operation S500 (see FIG. 23).

In some examples, the washing cycle can further include a second purification operation S600 (see FIG. 23), a third supply operation S700 (FIG. 23), and a second rinsing operation S800 (see FIG. 23) between the first rinsing operation S500 (see FIG. 23) and the exhaust operation S900 (see FIG. 23).

Figure 18:
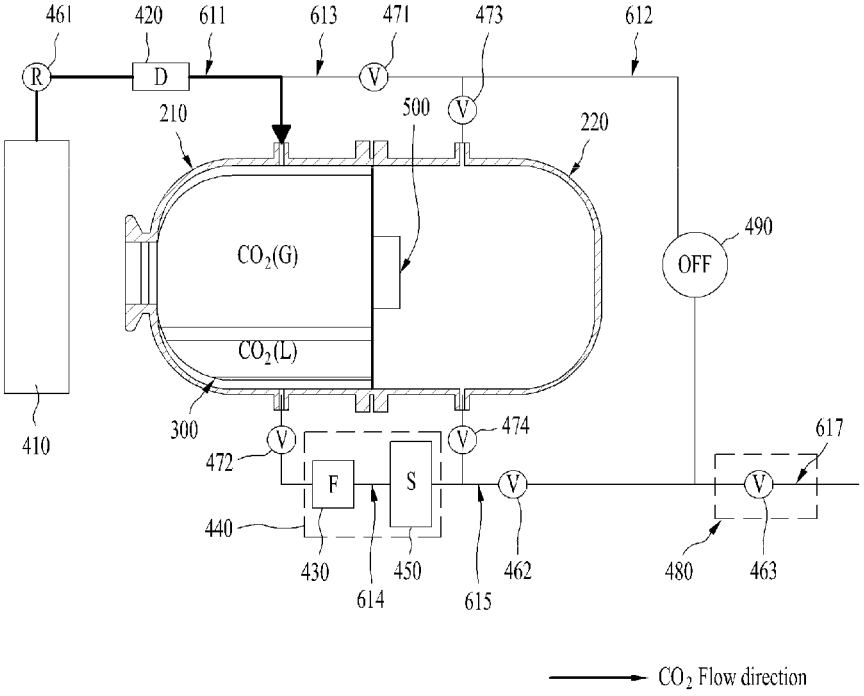
FIG. 18 shows an example of a first supply operation of supplying carbon dioxide to a washing chamber prior to performing a washing operation during a washing cycle.

Referring to FIG. 18, the first supply operation (S100) of supplying carbon dioxide to the washing chamber through the supplying member is shown.

The supplying member 410 and the first chamber 210 can be connected to each other by the first supply pipe 611. Specifically, the first supply pipe 611 can be connected to the first connector 231 disposed on the first housing 211 of the supplying member 410. Therefore, carbon dioxide can be supplied to the first chamber 210. In some examples, the supplying member 410 can include the flow rate regulator 461 capable of opening and closing the first supply pipe 611.

It is shown in FIG. 17 that the flow rate regulator 461 is located between the supplying member 410 and the first chamber, but the flow rate regulator 461 is able to be located anywhere as long as the flow rate regulator 461 is able to supply carbon dioxide to the first chamber 210 by opening and closing the supplying member 410.

The flow rate regulator 461 can be the regulator that controls the fluid pressure and the flow rate of the supplying member, but may not be limited thereto. The flow rate regulator 461 can be in a simple valve shape. This is because pressures of the supplying member 410 and the first chamber 210 can become in an equilibrium state by simply opening the valve. For example, the equilibrium state can be achieved when the gas pressures in the supplying member 410 and the first chamber 210 are balanced or equal to each other.

In some examples, a pressure of the supplying member 410 before opening the flow rate regulator 461 will be greater than a pressure of the supplying member 410 after opening the flow rate regulator 461. This is because carbon dioxide flows to the first chamber 210.

When the controller 600 opens the flow rate regulator 461 and closes the connection valve 471, carbon dioxide will flow from the supplying member 410 with higher pressure into the first chamber 210 with lower pressure. The controller 600 will close all other valves except the flow rate regulator 461.

During the supply of carbon dioxide from the supplying member 410 to the first chamber 210, carbon dioxide can pass through a detergent supply. Alternatively, some carbon dioxide branched from the first supply pipe can pass through the detergent supply. Alternatively, before supplying carbon dioxide, detergent can be supplied from the detergent supply through a separate pipe. The reason for using the detergent is to remove the hydrophilic contaminants because carbon dioxide is hydrophobic.

The flow rate regulator 461 can separately include a valve for supplying gaseous carbon dioxide and a valve for supplying liquid carbon dioxide. Although it is not separately shown in FIG. 18 for the sake of simplicity, liquid carbon dioxide can be supplied after the supplying member 410 and the first chamber 210 reach the pressure equilibrium by supplying gaseous carbon dioxide first. In some examples, liquid carbon dioxide can be supplied by the vertical level difference rather than by the pressure difference. FIG. 5 shows an example in which the supplying member is located above the pressure vessel.

Referring to FIG. 18, as an example of the pipe that connects the second chamber 220 and the first chamber 210 to each other, the first supply pipe 611 can be connected to the supply connection pipe 613 that connects the second chamber 220 and the first chamber 210, specifically, the first protruding end 233 and the first connector 231 to each other. By controlling the opening and closing of the appropriate valve (including the flow rate regulator 461), liquid carbon dioxide in the second chamber 220 can be transferred to the first chamber 210.

When the supply of carbon dioxide to the first chamber 210 is completed, the controller 600 can control the driver 500 to rotate the drum at the first rotation speed. Therefore, friction can be created between liquid carbon dioxide and the laundry accommodated in the drum to remove the contaminants attached to or adsorbed to the laundry from the laundry.

Figure 19:
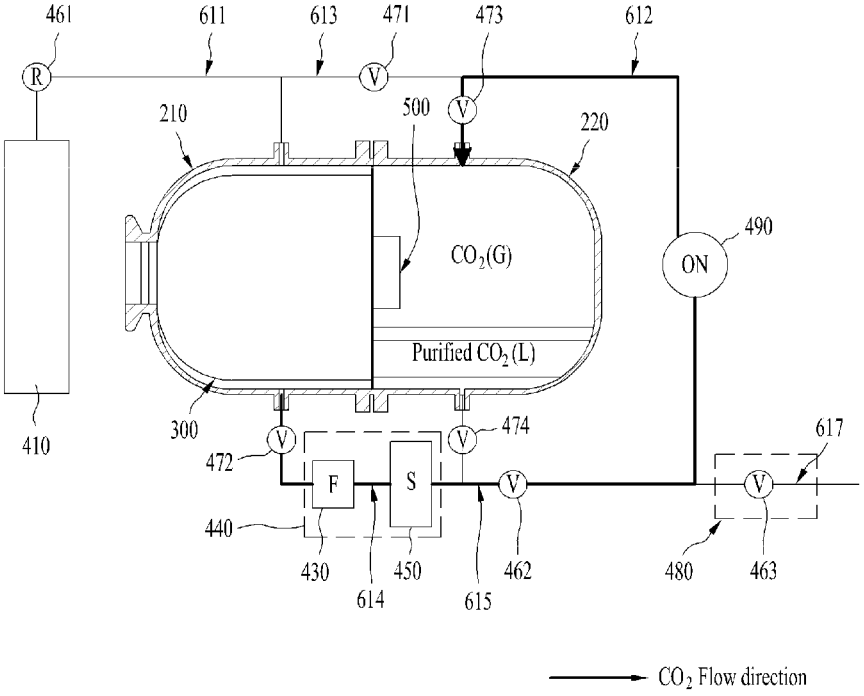
FIG. 19 shows an example of a first purification operation of purifying carbon dioxide used after a washing process is completed.

Thereafter, liquid carbon dioxide that is used in the first chamber 210, and thus, contains the contaminants mixed or dissolved therein is discharged. FIG. 19 shows the first purification operation (S300) of removing the contaminants through the purifier 440 after the washing operation (S200) in which the drum 300 rotates at the first rotation speed is completed.

Referring to FIG. 19, the transferring member 490 can remove the contaminants from liquid carbon dioxide discharged from the first chamber 210, and then, transfer liquid carbon dioxide from which the contaminants are removed to the second chamber 220. For example, the first discharge pipe 614 for connecting liquid carbon dioxide containing the contaminants discharged from the first chamber to the transferring member 490 can be combined to the second discharge pipe 615 for connecting the second chamber 220 and the transferring member 490 to each other.

Alternatively, the second discharge pipe 615 for transferring carbon dioxide discharged from the second chamber to the transferring member 490 can be connected to the first discharge pipe 614 for connecting the first chamber 210 and the transferring member to each other. Alternatively, the connection of the first discharge pipe 614 and the second discharge pipe 615 can be achieved in any scheme as long as carbon dioxide contaminated in the first chamber 210 is able to be transferred to the second chamber 220 through the transferring member 490, or carbon dioxide stored in the second chamber 220 is able to be transferred to the first chamber 210.

The second discharge pipe 615 can include the second discharge valve 474 that controls opening and closing of the second discharge pipe, wherein the second discharge valve 474 is located downstream of the first discharge pipe 614. In some examples, after being combined with the first discharge pipe 614, the second discharge pipe 615 can include the circulation valve 462 located upstream of the transferring member 490.

Referring to FIG. 19, the first discharge pipe 614 and the second discharge pipe 615 can be combined with each other, and the purifier 440 can be positioned on the first discharge pipe 614 upstream of the second discharge pipe 615. The purifier 440 can include one or more filters. For example, the purifier 440 can include the filtration assembly 430 and the oil separator 450 to filter the contaminants.

That is, the transferring member 490 can transfer liquid carbon dioxide discharged from the first chamber 210 to the second chamber 220 through the purifier 440. Because the pressures of the first chamber 210 and the second chamber 220 are in the equilibrium state, the transferring member 490 transfers liquid carbon dioxide present in the first chamber 210 to the second chamber 220.

The transferring member 490 can be the compressor or the pump capable of compressing or transferring the fluid. The transferring member 490 will mainly transfer liquid carbon dioxide. The transferring member 490 and the second chamber 220 can be connected to each other through the second supply pipe 612. In some examples, a second supply valve can be disposed between the transferring member 490 and the second chamber 220.

In some examples, the second discharge pipe 615 can be branched into the external exhaust pipe 617 that exhausts carbon dioxide to the outside. The first discharge pipe 614 and the second discharge pipe 615 can be combined with each other and then pass through the circulation valve 462, and the external exhaust pipe 617 can be branched from the second discharge pipe 615 at the position upstream of the circulation valve 462.

The second supply valve will open and close the second supply pipe 612. Accordingly, carbon dioxide leaked from the transferring member 490 will flow to the second chamber 220 through the second supply pipe 612 connected to the first protruding end 233.

When the washing of the laundry is completed, liquid carbon dioxide will contain the contaminants removed from the laundry. The contaminants can contain the foreign substances attached to the laundry and the lipophilic substances attached to the laundry. The foreign substances suspended in liquid carbon dioxide can be filtered by the filtration assembly 430, and the lipophilic substances dissolved in liquid carbon dioxide can be filtered by the oil separator 450.

The oil separator 450 can also be used to separate oil used for lubrication of the compressor or the pump used in the transferring member 490. The transferring member 490 can be connected to the oil separator 450 through the separate pipe. Alternatively, oil can be separated through the oil separator 450 while circulating with liquid carbon dioxide.

In a description from a point of view of the controller 600, after stopping the drum from rotating at the first rotation speed, the controller 600 can open the first discharge valve 472, the circulation valve 462, and the supplying valve 473, and close the flow rate regulator 461, the exhaust valve 463, the second discharge valve 474, and the connection valve 471. In some examples, the controller 600 can operate the transferring member 490. Therefore, carbon dioxide discharged from the first chamber 210 will flow to the second chamber 220 and be stored in the second chamber 220. In some examples, because carbon dioxide passes through the purifier 440, carbon dioxide stored in the second chamber 220 can be purified carbon dioxide.

Liquid and gaseous carbon dioxide can coexist in the second chamber 220 as well. In some examples, the first chamber 210, which has discharged most of liquid carbon dioxide into the second chamber 220, can contain gaseous carbon dioxide that is in pressure equilibrium with the second chamber 220 through the second through-hole 2512.

Figure 20:
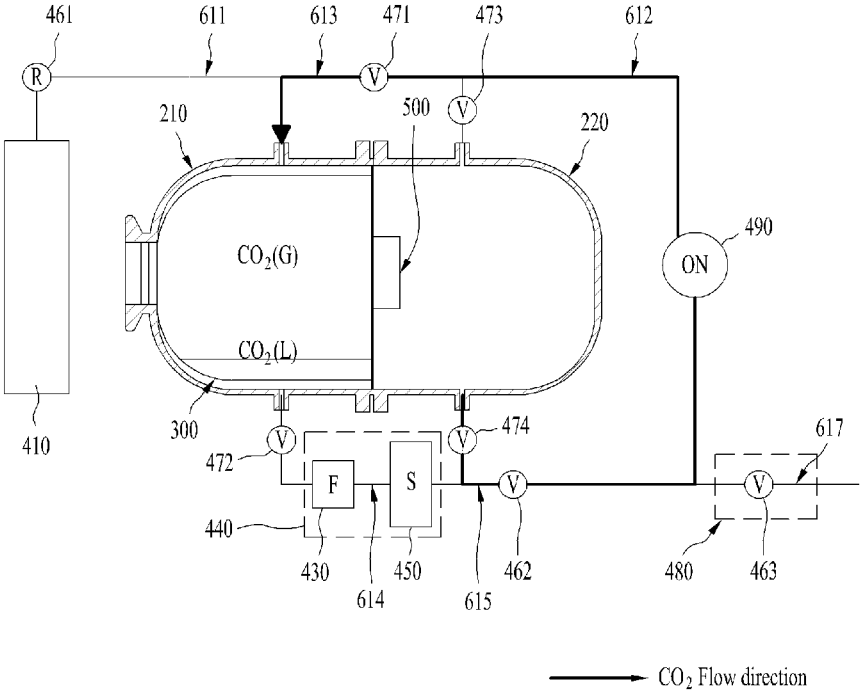
FIG. 20 shows an example of a second supply operation of supplying carbon dioxide that has been subjected to a first purification operation to a first chamber again before performing a first rinsing operation.

FIG. 20 shows the second supply operation (S400) of supplying carbon dioxide that has been subjected to the first purification operation (S300) to the first chamber again before performing the first rinsing operation (S500).

Referring to FIG. 20, the transferring member 490 can transfer liquid carbon dioxide stored in the second chamber 220 to the first chamber 210. Because the pressures of the first chamber 210 and the second chamber 220 are in the equilibrium state, the transferring member 490 transfers liquid carbon dioxide present in the first chamber 210 to the second chamber 220.

In a description from the point of view of the controller 600, in order to perform the rinsing operation in which the drum rotates at the second rotation speed, the controller 600 can open the second discharge valve 474, the circulation valve 462, and the connection valve 471, and close the exhaust valve 463, the first discharge valve 472, and the supplying valve 473. Therefore, carbon dioxide discharged from the second chamber 220 will flow to the first chamber 210.

Because gaseous carbon dioxide present in one of the first chamber and the second chamber 220 can flow to the other chamber through the second through-hole 2512, the first chamber 210 and the second chamber 220 will be in the pressure equilibrium.

After liquid carbon dioxide is supplied to the first chamber 210 (S400), the controller 600 can rotate the drum 300 at the preset second rotation speed. This is referred to as the first rinsing operation (S500).

Figure 21:
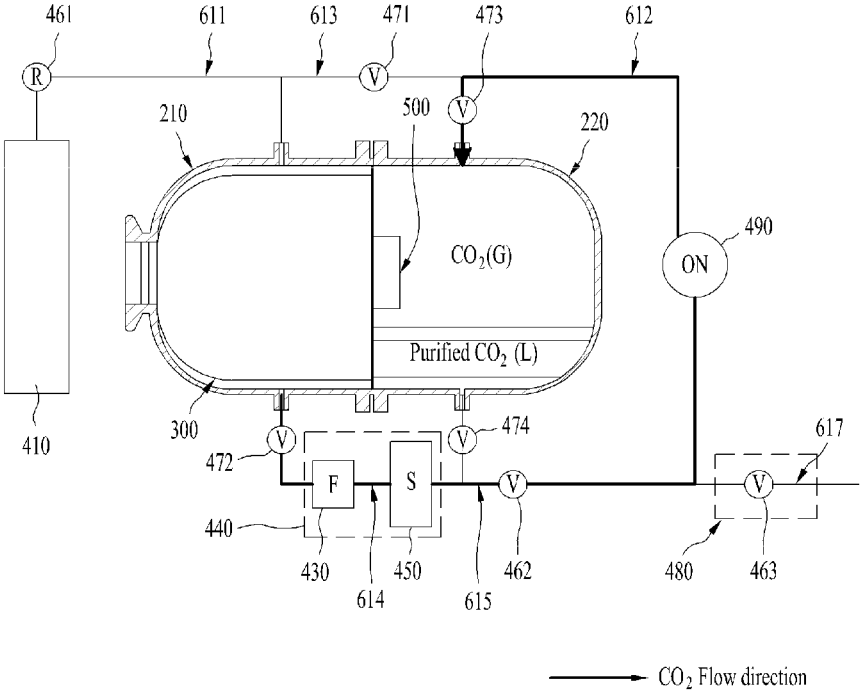
FIG. 21 shows an example of a second purification operation of purifying carbon dioxide used in a first rinsing operation prior to a second rinsing operation.

FIG. 21 shows the second purification operation (S600) of purifying carbon dioxide used in the first rinsing operation (S500) prior to the second rinsing operation (S800). A basic process can be the same as that of the first purification operation (S300) shown in FIG. 19.

After stopping the drum from rotating at the second rotation speed, the controller 600 can open the first discharge valve 472, the circulation valve 462, and the supplying valve 473, and close the flow rate regulator 461, the exhaust valve 463, the second discharge valve 474, and the connection valve 471. In some examples, the controller 600 can operate the transferring member 490. Therefore, carbon dioxide discharged from the first chamber 210 will flow to the second chamber 220 and be stored in the second chamber 220. In some examples, because carbon dioxide passes through the purifier 440, carbon dioxide stored in the second chamber 220 can be purified carbon dioxide.

The transferring member 490 can transfer liquid carbon dioxide discharged from the first chamber 210 to the second chamber 220 through the purifier 440. Because the pressures of the first chamber 210 and the second chamber 220 are in the equilibrium state, the transferring member 490 transfers liquid carbon dioxide present in the first chamber 210 to the second chamber 220. Thereafter, the transferring member 490 will transfer carbon dioxide stored in the second chamber 220 to the first chamber 210 (S800), and the controller 600 will rotate the drum 300 at a preset third rotation speed for a preset third time period (S800).

Figure 22:
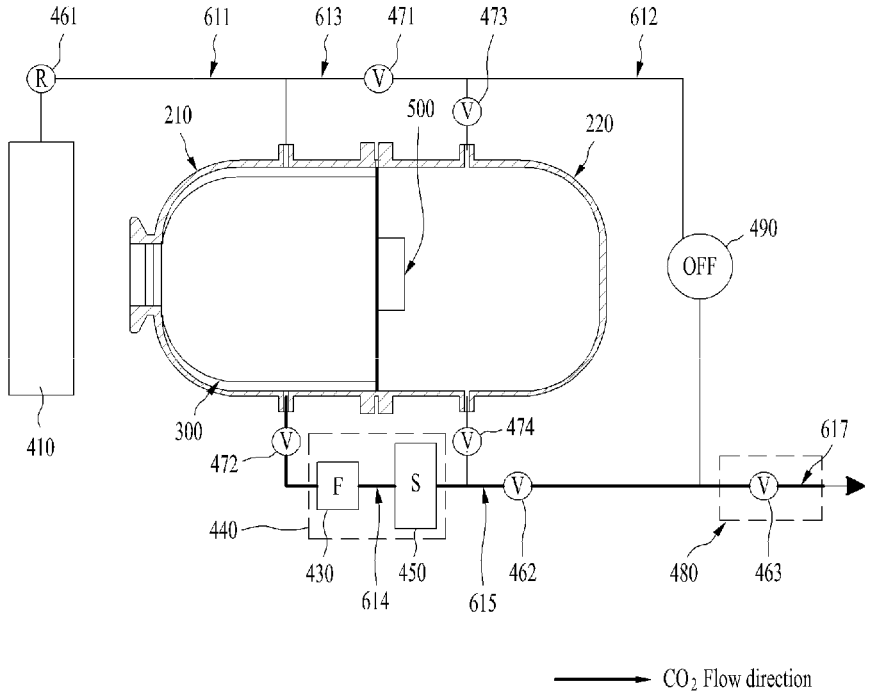
FIG. 22 shows an example of an exhaust operation of discharging carbon dioxide in a first chamber to the outside after a second rinsing operation is completed.

FIG. 22 shows an exhaust operation of discharging carbon dioxide in the first chamber 210 to the outside.

Referring to FIG. 22, after stopping the drum 300 from rotating at the third rotation speed, the controller 600 can open the first discharge valve 472, the circulation valve 462, and the exhaust valve 463, and close the flow rate regulator 461, the supplying valve 473, the second discharge valve 474, and the connection valve 471. Even when the transferring member 490 does not operate, carbon dioxide may leak to the outside through the exhaust portion 480 by the pressure difference between the first chamber 210 and the outside. While leaking, all the carbon dioxide can be vaporized.

When the washing cycle is completed, the exhaust portion 480 will discharge carbon dioxide accommodated in the first chamber 210 to the outside.

In other words, as the exhaust portion 480 discharges carbon dioxide accommodated in the first chamber 210 to the outside, the washing cycle can be completed.

Referring to FIGS. 18 to 22, the control method of the laundry treating apparatus 1000 includes the washing operation (S200) of rotating the drum 300 at the preset first rotation speed for the preset first rotation time to rub the liquid of the fluid with the laundry to remove the contaminants from the laundry for the washing cycle, and the first purification operation (S100) in which the transferring member 490 discharges the liquid from the first chamber 210, then allows the liquid to pass through the purifier 440 for purifying the contaminants mixed with the liquid, and then transfers the liquid to the second chamber 220.

In some examples, the supply operation (S400) in which the transferring member 490 supplies the liquid stored in the second chamber 220 to the first chamber 210, the rinsing operation (S500) of rotating the drum 300 at the second rotation speed for the preset second time period to rub the liquid of the fluid with the laundry to remove the contaminants from the laundry (S500), and the exhaust operation (S900) of discharging the fluid to the outside through the exhaust portion 480 after the second time period has elapsed can be further included.

The laundry treating apparatus 1000 can further include the supplying member 410 of supplying carbon dioxide to the first chamber 210. In this case, the method for controlling the laundry treating apparatus 1000 can further include the first supply operation (S100) in which the supplying member 410 supplies carbon dioxide to the first chamber 210 before the drum 300 rotates at the first rotation speed for a first time period.

When the operation of transferring carbon dioxide stored in the supplying member 410 to the first chamber 210 is referred to as the first supply operation (S100), the supply operation (S400) in which the transferring member 490 supplies the liquid stored in the second chamber 220 to the first chamber 210 before the drum 300 rotates at the second rotation speed for the second time period can be referred to as the second supply operation.

FIG. 23 is a flowchart showing an example of a method for controlling a washing cycle. The control method of the present disclosure will receive the user input to perform the washing cycle. For example, the method for controlling the laundry treating apparatus including the pressure vessel that accommodates the fluid having a pressure higher than the atmospheric pressure therein, the separator that separates the interior of the pressure vessel into the first chamber in which the cylindrical drum that is rotatably disposed and accommodates the laundry is located, and the second chamber that stores the fluid, the driver that rotates the drum, and the transferring member that transfers the fluid between the first chamber and the second chamber can include the first supply operation (S100) of supplying the fluid to the first chamber 210 from the supplying member 410 that stores and supplies the fluid, the washing operation (S200) of rotating the drum 300 at the preset first rotation speed until the preset first time period elapses, the first purification operation (S300) of discharging the fluid accommodated in the first chamber 210 through the transferring member 490 when the first time period elapses, then removing the contaminants mixed in the fluid through the purifier 440, and then transferring the purified liquid to the second chamber 220 and storing the purified liquid in the second chamber 220, the second supply operation (S400) of supplying the fluid stored in the second chamber 220 to the first chamber 210 through the transferring member 490, the first rinsing operation (S500) of rotating the drum 300 at the preset second rotation speed until the second preset time period elapses, and the exhaust operation (S900) of discharging the fluid accommodated in the first chamber 210 to the outside through the exhaust portion 480.

In some implementations, where the washing operation (S200) alone is insufficient to remove the contaminants, the rinsing operations (S500 and S800) can be performed. In some examples, the rinsing operation can be repeated two or more times as shown in FIG. 23.

For example, the method for controlling the laundry treating apparatus 1000 can further include, between the first rinsing operation (S500) and the exhaust operation (S900), the second purification operation (S600) of discharging the fluid accommodated in the first chamber through the transferring member 490, then removing the contaminants mixed in the fluid through the purifier 440, and then transferring the purified liquid to the second chamber 220 and storing the purified liquid in the second chamber 220, the third supply operation (S700) of supplying the fluid stored in the second chamber to the first chamber 210 through the transferring member 490, and the second rinsing operation (S800) of rotating the drum 300 at the preset third rotation speed until the third preset time period elapses.

As described above, the fluid can be carbon dioxide.

In the first supply operation (S100), the control method of the present disclosure will supply carbon dioxide stored in the supplying member 410 to the first chamber 210 until the pressures of the supplying member 410 and the first chamber 210 reach the equilibrium state. Whether the pressure equilibrium is reached can be measured by a pressure sensor or a flow sensor, but it can be determined that the pressure equilibrium has been reached after a preset supply time period has elapsed.

Alternatively, when the pressure of the first chamber 210 reaches the preset chamber pressure, the flow rate regulator 461 can be closed. In this case, the laundry treating apparatus 1000 can further include the pressure sensor capable of measuring the pressure of the first chamber 210. The pressure sensor can be located anywhere as long as the pressure sensor can measure the pressure of gaseous carbon dioxide in the first chamber 210.

While the detergent can be added for the washing operation (S200) in the first supply operation (S100), the detergent may not be added in the rinsing operations (S500 and S800).

In the control method of the present disclosure, when the flow rate regulator 461 is opened and the connection valve 471 is closed in the first supply operation (S100), carbon dioxide will flow from the supplying member 410 with the higher pressure to the first chamber 210 with the lower pressure. In some examples, the control method of the present disclosure will close the other valves except the flow rate regulator 461.

When the pressures of the supplying member 410 and the first chamber 210 reach the equilibrium state, the control method of the present disclosure can proceed with the washing operation (S200) of rotating the drum 300 at the first rotation speed for the preset first time period to remove the contaminants attached to the laundry using the friction between liquid carbon dioxide and the laundry.

Specifically, the washing operation (S200) can include foreign substance removal, cloth dispersion, and fluid dewatering processes. Accordingly, the first rotation speed can be set differently depending on a specific process. This is applied to the rinsing operations (S500 and S800) in the same manner.

In the washing operation (S200), all valves except the flow rate regulator 461 will be in the closed state.

When the first time period elapses, the control method of the present disclosure will stop the drum 300 from rotating at the first rotation speed, and will proceed with the first purification operation (S300). In the first purification operation (S300), the control method of the present disclosure can open the first discharge valve 472, the circulation valve 462, and the supplying valve 473, and close the flow rate regulator 461, the exhaust valve 463, the second discharge valve 474, and the connection valve 471. In some examples, the transferring member 490 can be operated. Therefore, carbon dioxide discharged from the first chamber 210 will flow to the second chamber 220 and be stored in the second chamber 220. In some examples, because carbon dioxide passes through the purifier 440, carbon dioxide stored in the second chamber 220 can be purified carbon dioxide.

The first chamber 210 can include a water level sensor. The controller 600 can determine whether liquid carbon dioxide is discharged from the first chamber through the water level sensor. However, alternatively, the control method of the present disclosure can determine that the first purification operation (S300) is completed when a predetermined discharge time sufficient for liquid carbon dioxide to escape has elapsed.

When the first purification operation is completed, the control method of the present disclosure can open the second discharge valve 474, the circulation valve 462, and the connection valve 471, and close the flow rate regulator 461, the exhaust valve 463, the first discharge valve 472, and the supplying valve 473. Therefore, the discharged carbon dioxide will flow to the first chamber 210.

The second chamber 220 can also include the water level sensor. The controller 600 can determine whether all liquid carbon dioxide has been discharged through the water level sensor. However, alternatively, the control method of the present disclosure can determine that the second supply operation (S400) is completed when a predetermined second discharge time sufficient for liquid carbon dioxide to escape has elapsed.

Thereafter, the control method of the present disclosure will proceed with the first rinsing operation (S500) in which the drum 300 rotates at the preset second rotation speed for the preset second time period to rub liquid carbon dioxide with the laundry.

After the second time period has elapsed, the control method of the present disclosure can open the first discharge valve 472, the circulation valve 462, and the supplying valve 473, and close the flow rate regulator 461, the exhaust valve 463, the second discharge valve 474, and the connection valve 471 after stopping the drum 300 rotating at the second rotation speed. In some examples, the control method of the present disclosure can operate the transferring member 490 to perform the second purification operation (S600) of purifying the liquid carbon dioxide used in the first chamber 210 and transferring the liquid carbon dioxide to the second chamber 220.

The second purification operation (S600) can be the same as the first purification operation (S300). That is, the control method of the present disclosure can open the first discharge valve 472, the circulation valve 462, and the supplying valve 473, and close the flow rate regulator 461, the exhaust valve 463, the second discharge valve 474, and the connection valve 471. In some examples, the transferring member 490 can be operated.

When the second purification operation (S600) is completed, the control method of the present disclosure will perform the third supply operation (S700) of transferring the liquid carbon dioxide stored in the second chamber 220 back to the first chamber 210, and the second rinsing operation (S800) of rotating the drum 300 at the preset third rotation speed for the preset third time period to rub the liquid carbon dioxide with the laundry.

In the third supply operation (S700), the control method of the present disclosure can open the second discharge valve 474, the circulation valve 462, and the connection valve 471, and close the flow rate regulator 461, the exhaust valve 463, the first discharge valve 472, and the supplying valve 473. Therefore, the discharged carbon dioxide will flow to the first chamber 210.

In the control method of the present disclosure in the first rinsing operation (S500) and the second rinsing operation (S800), the flow rate regulator 461, the exhaust valve 463, the first discharge valve 472, and the supplying valve 473 are in the closed state, and it is free for the second discharge valve 474, the circulation valve 462, and the connection valve 471 to be opened. This is because the pressures of the first chamber 210 and the second chamber 220 are in the equilibrium state.

In the exhaust operation (S900), the control method of the present disclosure can open the first discharge valve 472, the circulation valve 462, and the exhaust valve 463, and close the flow rate regulator 461, the supplying valve 473, the second discharge valve 474, and the connection valve 471. Even when the transferring member 490 does not operate, carbon dioxide will flow out through the exhaust portion 480 by the pressure difference between the first chamber 210 and the outside. As carbon dioxide leaks, all the carbon dioxide will vaporize.

The present disclosure is able to be modified and implemented in various forms, so that the scope thereof is not limited to the above-described implementations. Therefore, when the modified implementation includes the components of the claims of the present disclosure, it should be viewed as belonging to the scope of the present disclosure.

What is claimed is:

1. A laundry treating apparatus comprising:

a pressure vessel configured to receive fluid and to maintain a pressure therein to be higher than an atmospheric pressure;

a separator that divides the pressure vessel into (i) a first chamber that is a space configured to treat laundry using liquid carbon dioxide and (ii) a second chamber that is a space configured to store liquid carbon dioxide;

a drum rotatably disposed in the first chamber and configured to accommodate the laundry therein;

a driver configured to rotate the drum; and a pump configured to cause the fluid to flow between the first chamber and the second chamber.

2. The laundry treating apparatus of claim 1, wherein the driver is located in the second chamber and comprises (i) a motor configured to generate a rotation force and (ii) a rotation shaft connected to the drum and configured to transmit the rotation force of the motor, wherein the separator comprises a support plate that separates the first chamber and the second chamber from each other, the support plate defining a first through-hole passing therethrough, and wherein the rotation shaft is inserted into the first through-hole and connected to the drum.

3. The laundry treating apparatus of claim 2, wherein the support plate further defines at least one second through-hole that is spaced apart from the first through-hole and that is defined through the support plate, wherein the first chamber and the second chamber are configured to accommodate the fluid in a gas state, a liquid state, or both, and wherein the at least one second through-hole is configured to communicate the fluid in the gas state between the first chamber and the second chamber to thereby maintain the first chamber and the second chamber in a pressure equilibrium.

4. The laundry treating apparatus of claim 3, wherein the pressure vessel comprises:

a first housing that defines the first chamber and accommodates the drum therein, the first housing defining (i) a chamber inlet configured to receive and withdraw the laundry therethrough and (ii) a first opening facing opposite to the chamber inlet; and a second housing that defines the second chamber and is coupled to the first housing, the second housing defining a second opening facing the first opening, wherein the separator is coupled to the first housing or the second housing, and wherein the support plate is coupled to the first housing and located closer to the first opening than to the second opening, the support plate having a first side facing the first housing and a second side facing the second housing.

5. The laundry treating apparatus of claim 4, further comprising a cabinet that accommodates the pressure vessel therein, wherein a vertical level of a center of the at least one second through-hole with respect to a bottom side of the cabinet is higher than a vertical level of a center of the first through-hole.

6. The laundry treating apparatus of claim 5, wherein the at least one second through-hole is located above a vertical level of the fluid in the liquid state accommodated in the first chamber or the second chamber with respect to the bottom side of the cabinet such that the fluid in the liquid state does not flow through the at least one second through-hole.

7. The laundry treating apparatus of claim 3, wherein the separator further comprises a heat exchanger that is located between the drum and the support plate, that is coupled to a side of the support plate facing the drum, and that is configured to supply heat to the first chamber, the heat exchanger comprising:

a first refrigerant pipe configured to supply a refrigerant to the heat exchanger, a second refrigerant pipe configured to discharge the refrigerant that has circulated through the heat exchanger, and a connection refrigerant pipe that connects the first refrigerant pipe and the second refrigerant pipe to each other and is configured to supply heat to the fluid accommodated in the first chamber, wherein the heat exchanger defines a central cavity that faces the first through-hole, a size of the central cavity being greater than or equal to a size of the first through-hole, wherein the rotation shaft is inserted into and passes through the central cavity, and wherein the first refrigerant pipe or the second refrigerant pipe is inserted into the at least one second through-hole and connected to the heat exchanger.

8. The laundry treating apparatus of claim 7, wherein the separator further comprises a heat insulator located between the heat exchanger and the support plate and configured to block heat transfer from the heat exchanger to the second chamber, wherein the heat insulator comprises a heat insulator body that is made of a thermal insulation material, the heat insulator body defining:

a first heat insulator hole facing the first through-hole, a size of the first heat insulator hole being greater than or equal to the size of the first through-hole, and at least one second heat insulator hole facing the at least one second through-hole, and wherein a number and a size of the at least one second heat insulator hole correspond to a number and a size of the at least one second through-hole, respectively.

9. The laundry treating apparatus of claim 2, wherein the driver further comprises:

a bearing housing assembly that couples the motor to the support plate and is configured to rotatably support the rotation shaft; and a motor protection cover that covers the motor and the bearing housing assembly and is configured to block the fluid in a liquid state accommodated in the first chamber or the second chamber from contacting the motor and the bearing housing assembly, and wherein the motor protection cover defines at least one cover communication hole passing therethrough, a vertical level of the at least one cover communication hole being higher than a vertical level of the fluid in the liquid state accommodated in the second chamber.

10. The laundry treating apparatus of claim 1, further comprising a purifier configured to remove contaminants from the fluid discharged from the first chamber.

11. The laundry treating apparatus of claim 1, wherein the fluid comprises carbon dioxide in a gas state, a liquid state, or both, and wherein the laundry treating apparatus further comprises a tank configured to store the carbon dioxide to be supplied to the first chamber.

12. The laundry treating apparatus of claim 11, further comprising a flow rate regulator configured to supply the carbon dioxide stored in the tank to the first chamber until a pressure in the first chamber reaches an equilibrium with a pressure in the tank.

13. The laundry treating apparatus of claim 12, wherein the first chamber is configured to accommodate both liquid carbon dioxide and gaseous carbon dioxide therein in a state in which the pressure in the first chamber reaches the equilibrium with the pressure in the tank, and wherein the drum is configured to, based on the pressure in the first chamber reaching the equilibrium with the pressure in the tank, rotate at a preset first rotation speed for a preset first time period to thereby remove contaminants from the laundry by bringing the laundry into contact with the liquid carbon dioxide in the first chamber.

14. The laundry treating apparatus of claim 13, further comprising a purifier configured to purify the liquid carbon dioxide discharged from the first chamber, wherein the driver is configured to stop rotating the drum based on an elapse of the preset first time period since starting to rotate at the preset first rotation speed, and wherein the pump is configured to, based on the drum stopping rotation, cause the liquid carbon dioxide mixed with the contaminants removed from the laundry to discharge from the first chamber, pass through the purifier, and be stored in the second chamber.

15. The laundry treating apparatus of claim 14, wherein the pump is configured to cause the liquid carbon dioxide stored in the second chamber to be supplied back to the first chamber.

16. The laundry treating apparatus of claim 15, wherein the driver is configured to rotate the drum at a preset second rotation speed for a preset second time period based on the liquid carbon dioxide stored in the second chamber being transferred back to the first chamber after the elapse of the preset first time period.

17. The laundry treating apparatus of claim 16, further comprising an exhaust portion configured to discharge the carbon dioxide accommodated in the pressure vessel, wherein the driver is configured to stop rotating the drum based on an elapse of the preset second time period since starting to rotate at the preset second rotation speed, and wherein the exhaust portion is configured to discharge the carbon dioxide accommodated in the pressure vessel to an outside of the exhaust portion based on the elapse of the preset second time period.

18. The laundry treating apparatus of claim 16, wherein the driver is configured to stop rotating the drum based on an elapse of the preset second time period since starting to rotate at the preset second rotation speed, and wherein the pump is configured to, based on the drum stopping rotation after the elapse of the preset second time period, cause the liquid carbon dioxide mixed with the contaminants removed from the laundry to discharge from the first chamber, pass through the purifier, and be stored in the second chamber.

19. The laundry treating apparatus of claim 16, wherein the pump is configured to cause the liquid carbon dioxide stored in the second chamber after the elapse of the preset second time period to be supplied back to the first chamber.

20. The laundry treating apparatus of claim 19, wherein the driver is configured to rotate the drum at a third rotation speed for a preset third time period based on the liquid carbon dioxide stored in the second chamber being transferred back to the first chamber after the elapse of the preset second time period.

* * * * *